US011320759B2

(12) United States Patent
Miura et al.

(10) Patent No.: US 11,320,759 B2
(45) Date of Patent: May 3, 2022

(54) IMAGE FORMING APPARATUS HAVING A VOLTAGE APPLYING UNIT THAT APPLIES VOLTAGE TO A REGULATING MEMBER

(71) Applicant: CANON KABUSHIKI KAISHA, Tokyo (JP)

(72) Inventors: Jun Miura, Kawasaki (JP); Yuki Yamamoto, Shiroi (JP); Takashi Hiramatsu, Tokyo (JP); Masanori Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/713,826

(22) Filed: Dec. 13, 2019

(65) Prior Publication Data

US 2020/0201202 A1 Jun. 25, 2020

(30) Foreign Application Priority Data

Dec. 25, 2018 (JP) ..... JP2018-241799

(51) Int. Cl.
*G03G 15/02* (2006.01)
*G03G 15/06* (2006.01)
(Continued)

(52) U.S. Cl.
CPC ..... *G03G 15/0225* (2013.01); *G03G 15/0266* (2013.01); *G03G 15/065* (2013.01);
(Continued)

(58) Field of Classification Search
CPC ..... G03G 15/0225
(Continued)

(56) References Cited

U.S. PATENT DOCUMENTS 5,182,600 A * 1/1993 Hasegawa ..... G03G 15/0849 355/77
2013/0272731 A1* 10/2013 Tsuruya ..... G03G 15/043 399/39

(Continued)

FOREIGN PATENT DOCUMENTS

JP 2005352388 A 12/2005
JP 2010002934 A 1/2010

(Continued)

*Primary Examiner* — Walter L Lindsay, Jr.
*Assistant Examiner* — Philipmarcus T Fadul
(74) *Attorney, Agent, or Firm* — Canon U.S.A., Inc. IP Division

(57) ABSTRACT

An image forming apparatus includes a rotatable photosensitive member. A charging member charges a surface of the photosensitive member. A developing roller carries developer. The developing roller supplies the developer in normal polarity to the surface of the photosensitive member. A regulating member regulates the developer on the developing roller. A common voltage applying unit applies charging voltage and regulating voltage. The regulating voltage is applied with the developing roller rotating such that a potential difference in a direction in which electrostatic force from the regulating member to the developing roller acts on the developer charged in the normal polarity, is formed between the regulating member and the developing roller, and in which the charging voltage to be applied in a non-image-forming period is controlled so as to be smaller in absolute value than in an image-forming period.

15 Claims, 18 Drawing Sheets

(51) Int. Cl.
*G03G 15/00* (2006.01)
*G03G 15/08* (2006.01)

(52) U.S. Cl.
CPC ..... *G03G 15/0812* (2013.01); *G03G 15/0856* (2013.01); *G03G 15/5004* (2013.01); *G03G 15/80* (2013.01); *G03G 2215/025* (2013.01)

(58) Field of Classification Search
USPC ..... 399/50
See application file for complete search history.

(56) References Cited

U.S. PATENT DOCUMENTS

| | | | | |
|---|---|---|---|---|
| 2016/0091858 | A1* | 3/2016 | Shiraki | G03G 21/1676 399/12 |
| 2016/0252841 | A1* | 9/2016 | Goto | G03G 21/0064 399/55 |
| 2018/0113397 | A1* | 4/2018 | Ozeki | G03G 15/0812 |
| 2019/0018338 | A1* | 1/2019 | Ozeki | G03G 15/065 |

FOREIGN PATENT DOCUMENTS

| | | | |
|---|---|---|---|
| JP | 5007559 | B2 | 8/2012 |
| JP | 2018180379 | A | 11/2018 |

* cited by examiner

IMAGE FORMING APPARATUS HAVING A VOLTAGE APPLYING UNIT THAT APPLIES VOLTAGE TO A REGULATING MEMBER

BACKGROUND OF THE DISCLOSURE

Field of the Disclosure

The present disclosure relates to an electrophotographic apparatus, such as a copier, a printer, or a facsimile, for example.

Description of the Related Art

An image forming apparatus, such as a copier or a laser beam printer, irradiates an electrophotographic photosensitive member (photoconductive drum) uniformly charged by a charging unit, with light corresponding to image data, to form an electrostatic image (latent image). Then, a developing device supplies the electrostatic image with toner of a developer that is a recording material, resulting in visualization as a toner image. A transfer device transfers the toner image from the photoconductive drum to a recording medium, such as recording paper. A fixing device fixes the toner image on the recording medium, resulting in formation of a recorded image.

The developing device that performs development to the photoconductive drum, includes a roller-shaped developing roller r partially exposed, occluding the opening of a developer container housing the developer, and a developer regulating member that makes the developer that the developing roller conveys, constant in amount, in contact with the surface of the developing roller. For occlusion of the opening of the developer container, a sealing sheet having flexibility is used. When the developer adhering to the surface of the developing roller passes the developer regulating member along with rotation of the developing roller, the surplus of the developer is removed from the surface of the developing roller, so that the surplus is returned into the developer container. Simultaneously, the developer is formed as a thin layer on the developing roller, with friction charge given from the developer regulating member. The developer having the friction charge moves from the portion of the developing roller exposed from the developer container, onto the electrostatic latent image formed in advance on the surface of the photoconductive drum rotating opposite to the developing roller.

In a case where the friction charge of the thin-layered developer is insufficient in the developing device, because the developer has frictional force with the sealing sheet stronger than image force (adhesion force) with the developing roller, the developer is swept from the developing roller, resulting in occurrence of a phenomenon called dripping. Occurrence of dripping causes the developer to be originally returned into the developer container, to drop onto the photoconductive drum or the recording medium, resulting in adverse effect on an image. Thus, as a method of imparting sufficient friction charge to a developer, Japanese Patent No. 5007559 discloses a method of providing a potential difference between a developer regulating member and a developing roller.

However, a power circuit commonalized so as to output voltage to be applied to a charging member that charges the surface of a photoconductive drum and voltage to be applied to the developer regulating member, has the following issue. For inhibition of dripping, voltage requires applying to the developer regulating member to provide a potential difference between the developer regulating member and the developing roller. The power circuit commonalized so as to output charging voltage and voltage to be applied to the developer regulating member, needs to apply the charging voltage in order to apply the voltage to the developer regulating member. However, in a non-image-forming period, no charging voltage requires applying because no image forming is performed. Thus, the power circuit commonalized so as to output the charging voltage, outputs no voltage to the developer regulating member. Thus, dripping occurs due to friction charge shortage of the developer. Meanwhile, when application of the charging voltage continues for application of the voltage to the developer regulating member, similarly in an image-forming period, the photoconductive drum deteriorates due to discharging. Thus, adverse effect on an image is likely to occur.

SUMMARY OF THE DISCLOSURE

Thus, an aspect of the present disclosure is to provide an image forming apparatus including a power circuit commonalized so as to output voltage to be applied to a charging member and a developer regulating member, in which a photoconductive drum is inhibited from deteriorating due to discharging and developer dripping is inhibited from occurring.

According to a first aspect of the disclosure, an image forming apparatus is provided which configured to form an image onto a recording medium. The image forming apparatus includes a photosensitive member rotatable; a charging member configured to charge a surface of the photosensitive member; a developing roller configured to carry a developer and supply the developer charged in normal polarity to the surface of the photosensitive member; a regulating member configured to regulate the developer on a surface of the developing roller; a common voltage applying unit configured to apply charging voltage and regulating voltage to the charging member and the regulating member, respectively; and a control unit configured to control the voltage applying unit. An image-forming operation is performed in which the developer charged in the normal polarity is supplied to the surface of the photosensitive member to form a developer image for the formation of the image onto the recording medium, and a non-image-forming operation is performed in which the photosensitive member and the developing roller rotate, the non-image-forming operation being different from the image-forming operation. In a state of the developing roller rotated, the control unit controls the voltage applying unit such that the regulating voltage to be applied to the regulating member so as to form a potential difference between the regulating member and the developing roller, which acts an electrostatic force directed to the direction from the regulating member to the developing roller to the developer charged to the normal polarity. The control unit controls the voltage applying unit such that the charging voltage to be applied to the charging member in a period of the non-image-forming operation is smaller in absolute value than in a period of the image-forming operation.

Further features and aspects of the present disclosure will become apparent from the following description of example embodiments (with reference to the attached drawings).

DESCRIPTION OF THE EMBODIMENTS

Example embodiments of the present disclosure will be described below with reference to the drawings. Note that the following embodiments are examples, and thus the present disclosure is not limited to the contents of the embodiments. In the following figures, constituent elements unnecessary for description of the embodiments are omitted.

1. Example Image Forming Apparatus

Figure 1:
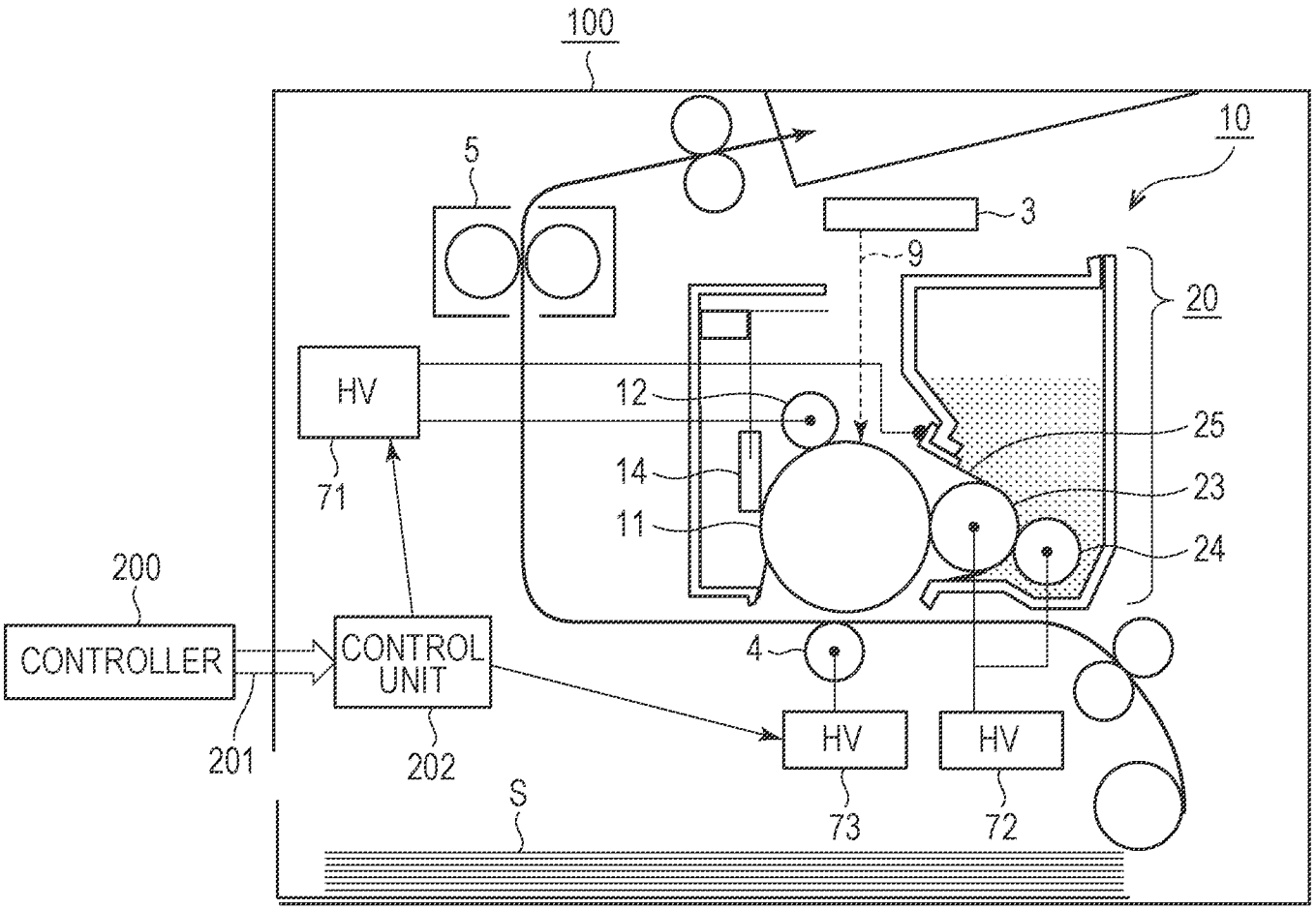
FIG. 1 illustrates the configuration of an image forming apparatus according to an example first embodiment.
Figure 2:
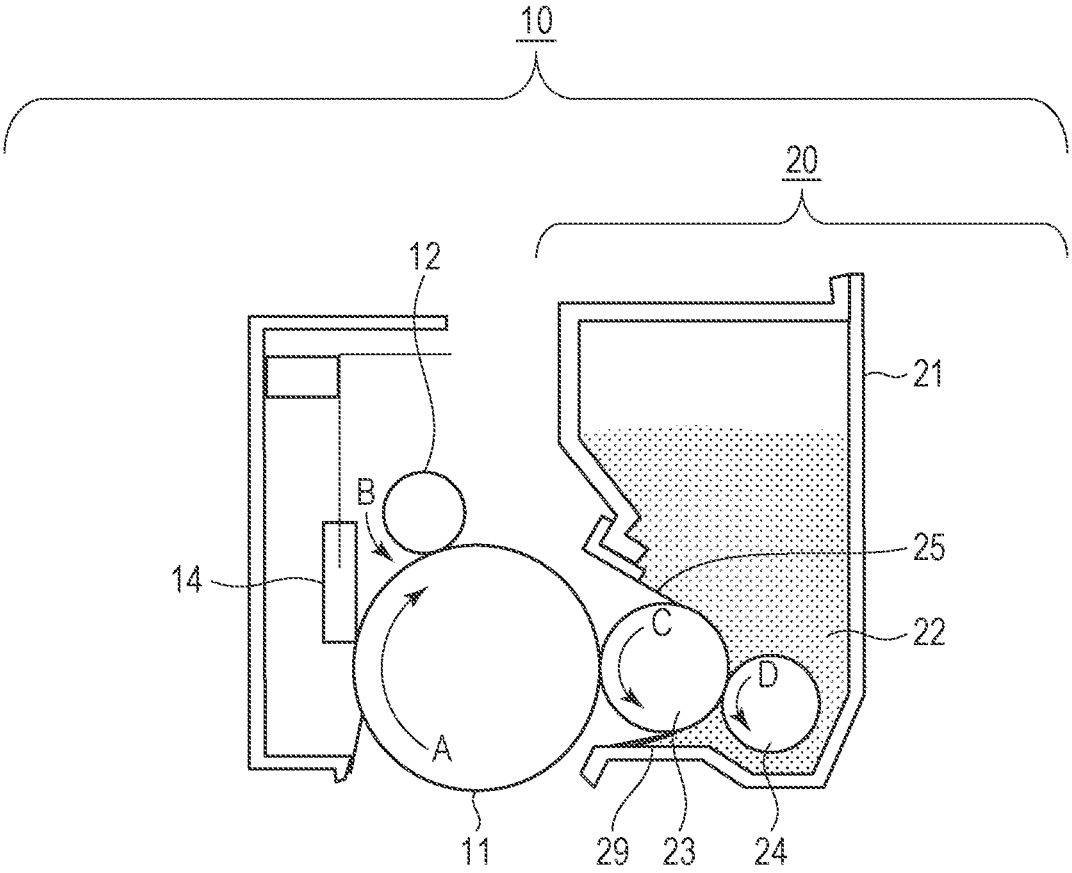
FIG. 2 illustrates the configuration of an example process cartridge according to the first embodiment.

An example configuration of an image forming apparatus will be described with reference to FIGS. 1 and 2. FIG. 1 schematically illustrates the configuration of the image forming apparatus 100 according to an embodiment of the present disclosure, in section, in which each constituent is simply illustrated. FIG. 2 is a schematic sectional view of a process cartridge according to the embodiment of the present disclosure.

First, an image forming process and each member will be described. With FIGS. 1 and 2, each member involved in the image forming processing will be described along the flow of the image forming process.

When image forming starts, a photoconductive drum 11 rotates at a process speed of 150 mm/sec in the direction of arrow A in FIG. 2, and a charging roller 12 rotates in the direction of arrow B in FIG. 2 while driven by the rotation of the photoconductive drum 11.

The photoconductive drum 11 that is a photosensitive member, includes a photoconductive material, such as an organic photoconductor (OPC), amorphous selenium, or amorphous silicon, provided on a drum base on a cylinder having an outer diameter of 24 mm, formed of, for example, aluminum or nickel. According to the present embodiment, the thickness of the photoconductive material is 15 μm.

The charging roller 12 that is a charging member, is a single-layer roller formed of a conductive cored bar and a conductive rubber layer. The charging roller 12 has an outer diameter of 7.5 mm and a volume resistivity of $10^3$ to $10^6$ Ω·cm.

A common high-voltage power source 71 to be described below that is a voltage applying unit as a common power source, applies a voltage of −1000 V as first charging voltage V1 for image forming, to the charging roller 12. Thus, the surface of the photoconductive drum 11 is uniformly charged at −460 V. The charging roller 12 is applied with a direct-current (DC) voltage of Vd+Vth. Through discharging, the charging roller 12 charges the surface of the photoconductive drum 11 uniformly at charging potential Vd. In this case, Vd represents dark potential and is −460 V. Vth represents discharge start voltage. When charging voltage to be applied is small, the surface potential on the photoconductive drum 11 is constant regardless of discharging. However, the surface potential starts to increase due to discharging from the discharge start voltage Vth. That is the discharge start voltage Vth according to the first embodiment is −540 V.

Figure 3:
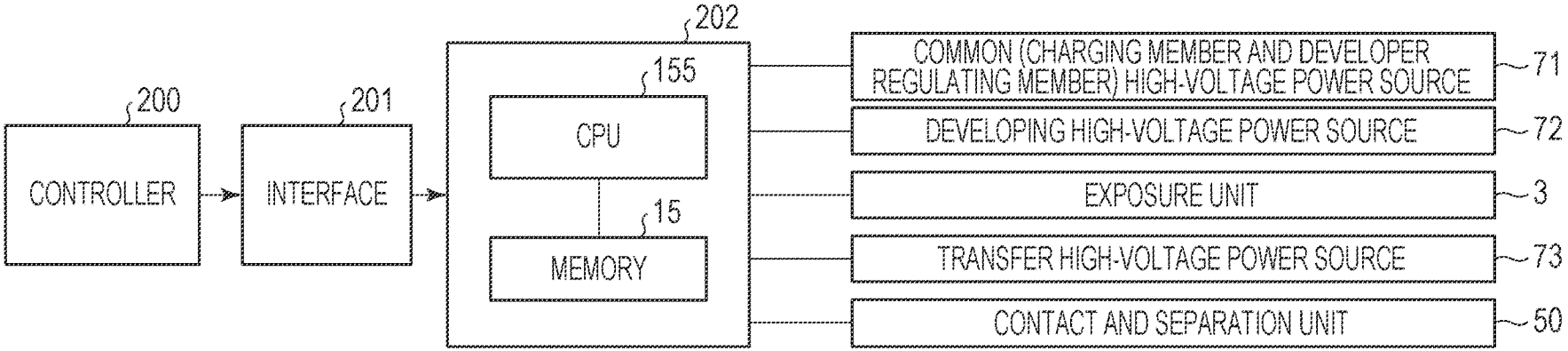
FIG. 3 is a block diagram of control according to the first embodiment.

After the charging roller 12 charges the surface of the photoconductive drum 11, an exposure unit 3 irradiates the surface of the photoconductive drum 11 with laser light 9. The surface potential of the surface of the photoconductive drum 11 irradiated with the laser light 9, varies to −100 V as V1 representing light potential, resulting in formation of an electrostatic latent image. As illustrated in FIG. 3, a control unit 202 inputs a time-series electric digital pixel signal regarding image information after image processing, input from a controller 200 through an interface 201, into the exposure unit 3. The exposure unit 3 includes a laser output unit that outputs the laser light 9 modulated corresponding to the input time-series electric digital pixel signal, a rotatable polygonal mirror (polygon mirror), an fθ lens, and a reflector. The exposure unit 3 performs main-scanning exposure to the surface of the photoconductive drum 11 with the laser light 9. An electrostatic latent image corresponding to the image information, is formed by the main-scanning exposure and sub-scanning due to rotation of the photoconductive drum 11.

After the photoconductive drum 11 starts to rotate, a developing device 20 moves a developing roller 23 as a developing roller having been spaced apart from the photoconductive drum 11, with a contact and separation unit 50, such that the developing roller 23 abuts on the photoconductive drum 11. The operation of the contact and separation unit 50 is controlled by the control unit 202 illustrated in FIG. 3.

Then, the developing roller 23 starts to rotate in the direction of arrow C in FIG. 2, and a toner supplying roller 24 as a developer supplying member starts to rotate in the direction of arrow D in FIG. 2. Then, a developing high-voltage power source 72 for the developing roller 23, applies a voltage of −300 V as developing voltage, to the developing roller 23. Then, the electrostatic latent image formed on the photoconductive drum 11, namely, the portion at V1 is supplied with a developer by the developing roller 23, resulting in development.

The developer image having been developed, is transferred to a recording medium S at a transfer portion that is the contact portion between the photoconductive drum 11 and a transfer roller 4, due to the potential difference to the transfer roller 4 applied with a voltage of +300 V by a transfer high-voltage power source 73 for the transfer roller 4. The transfer roller 4 includes a conductive cored bar and a pressure contact portion to the photoconductive drum 11, in which the pressure contact portion is formed of a semi-conductive sponge containing, as a main ingredient, NBR hydrin rubber that is an elastic body, and an adjustment in resistance is made with an ionic conductive material. The transfer roller 4 has an outer diameter of 12.5 mm and a core diameter of 6 mm. The resistance value applied with a voltage of 2 kV is LU to $3.0\times10^{8}\Omega$ under an ordinary-temperature and ordinary-humidity environment of 23° C./50%, $0.5\times10^{8}\Omega$ under a high-temperature and high-humidity environment of 32° C./80%, and $8.0\times10^{8}\Omega$ under a low-temperature and low-humidity environment of 15° C./10%. Thus, variation occurs in resistance depending on environments.

The recording medium S having the developer image transferred thereto, is conveyed to a fixing device 5, and then is subjected to heat and pressure. This arrangement causes the developer image to be fixed onto the recording medium S. After that, the recording medium S is ejected from the image forming apparatus 100. The developer that has not been transferred to the recording medium S, remaining on the photoconductive drum 11, is swept by a cleaning blade 14. Repetition of the process causes performance of consecutive image forming.

After the image forming finishes, the developing roller 23 is separated from the photoconductive drum 11 by the contact and separation unit 50. Then, a post-rotation operation is performed to reset the state inside the image forming apparatus 100, so that prompt printing can be performed when the next image for is performed. In that case, the developing roller 23 may rotate even after the separation by the contact and separation unit 50. That is provision of a drive source common between the developing roller 23 and the photoconductive drum 11 may cause synchronization between deactivation of rotation of the photoconductive drum 11 and deactivation of rotation of the developing roller 23. The common drive source contributes to reduction in cost and miniaturization for the image forming apparatus 100.

The control unit 202 that controls the operation of the image forming apparatus 100, transmits and receives various electric information signals. The control unit 202 performs processing of an electric information signal input from each type of process device or a sensor or performs processing of a command signal to each type of process device. FIG. 3 is a block diagram of a schematic control aspect of main units of the image forming apparatus 100 according to the first embodiment. The controller 200 transmits and receives various types of electric information between a host device and the controller 200, and additionally causes the control unit 202 to integrally control the image-forming operation of the image forming apparatus 100 in accordance with a predetermined control program and a predetermined reference table, through the interface 201. The control unit 202 includes a CPU 155 that is a central element that performs various types of arithmetic processing, and a memory 15 including a ROM and a RAM that are storage elements. The RAM stores, for example, a detected result of the sensor, a counted result of a counter, and an arithmetic result. The ROM stores, for example, the control program and the data table acquired in advance by experiment. The control unit 202 is connected with, for example, each control target, the sensor, and the counter in the image forming apparatus 100. The control unit 202 transmits and receives various electric information signals and controls the timing of drive of each unit, to control a predetermined image forming sequence, for example. For example, the control unit 202 controls respective voltages to be applied by the common high-voltage power source 71, the developing high-voltage power source 72, and the transfer high-voltage power source 73, and the amount of exposure of the exposure unit 3.

The common high-voltage power source 71 as a first voltage applying unit and the developing high-voltage power source 72 as a second voltage applying unit, will be described in detail below. In the image forming apparatus 100 of FIG. 1, the control unit 202 is connected to the common high-voltage power source 71 and the transfer high-voltage power source 73, but no connection is illustrated from the control unit 202 to the developing high-voltage power source 72 and the exposure unit 3. In practice, the control unit 202 controls each unit in connection. The image forming apparatus 100 performs image forming onto a recording medium S, on the basis of an electric image signal input from the host device to the controller 200. Note that examples of the host device include an image reader, a personal computer, a facsimile, and a smartphone.

2. Example Developing Device

Next, parts involved in a developing process, in the developing device 20 according to the present embodiment, will be described in detail with FIG. 2.

The developing device 20 includes a developer container 21 having an opening portion at the opposed position to the photoconductive drum 11. The developer container 21 houses toner 22 as the developer. The developing device 20 includes the developing roller 23 and the toner supplying roller 24. While carrying the toner 22, the developing roller 23 serves to convey the toner 22 to the electrostatic latent image on the photoconductive drum 11. The toner supplying roller 24 having a foam layer that rubs the surface of the developing roller 23, serves to supply the developing roller 23 with the toner 22 inside the developer container 21. Note that the toner supplying roller 24 and the developing roller 23 are in conduction, resulting in equality in potential. The developing device 20 includes a developing blade 25 that is a toner regulating member that regulates the toner 22 supplied to the developing roller 23. The developing blade 25 is formed of a SUS sheet having a thickness of 80 μm integrally supported by a supporting plate having a thickness of 1 mm. The leading end of the SUS sheet of the developing blade 25 abuts on the developing roller 23 at a pressure of 25 to 35 g/cm. The direction of the abutting is a counter direction in which the leading end on the free end side is located on the upstream side of the rotation direction of the developing roller 23 with respect to the abutting portion. The material, shape, and abutting pressure of the developing blade 25 are not limited to these. The toner 22 that is a non-magnetic monocomponent polymerized toner, has a surface to which 1.5 wt % of hydrophobic Si is added as an external additive having a particle diameter of 30 nm. The amount of external addition and the material to be added externally are not limited to these. Coating of the surface of the toner 22 with the external additive enables improvement in negative chargeability, and enables provision of minute gaps in the toner 22, resulting in improvement in fluidity.

In an image-forming period, the developing high-voltage power source 72 applies a voltage of −300 V as the developing voltage to the developing roller 23, and the common high-voltage power source 71 applies a voltage of −500 V to the developing blade 25. Developing blade voltage as developer regulating voltage will be described in detail below. According to the first embodiment, the potential of the developing blade 25 to the developing roller 23 is arranged on the negative polarity side. That is the voltage to be applied to the developing roller 23 larger in absolute value than the voltage to be applied to the developing blade 25, causes improvement in charge-providing performance to the toner 22 having negative chargeability as normal polarity. Thus, toner coating to the developing roller 23 is stabilized, resulting in inhibition of toner dripping in which toner low in charging amount is separated from the developing roller 23 outside the developer container 21, and inhibition of fog that is a phenomenon in which toner scattering over a white background occurs. Note that, according to the first embodiment, the developing high-voltage power source 72 is a power source that outputs fixed voltage, but output voltage may be variable.

Here, for potential or applied voltage in the following descriptions, the absolute value high on the negative polarity side (e.g., −1000 V to −460 V) is referred to as high potential, and the absolute value small on the negative polarity side (e.g., −300V to −460 V) is referred to as low potential. This is because, according to the first embodiment, the toner 22 having negative chargeability is considered as a reference.

According to the first embodiment, voltage is expressed as a potential difference to earth potential (0 V). Therefore, a developing voltage of −300 V is interpreted as a potential difference of −300 V to the earth potential, due to the developing voltage applied to the cored bar of the developing roller 23. Similarly, for example, the charging voltage, the developing blade voltage, and transfer voltage are interpreted.

3. Example Configuration of High-Voltage Power Source

Figure 4:
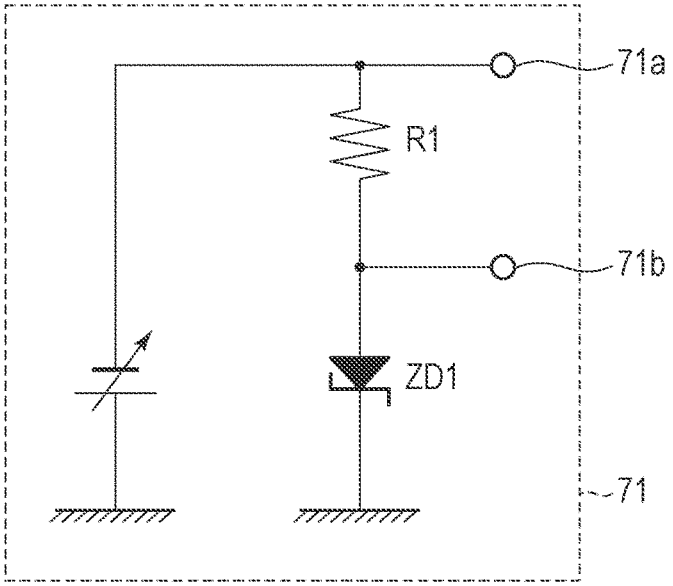
FIG. 4 illustrates the configuration of an example high-voltage power source according to the first embodiment.

Next, the configuration of a high-voltage power source according to the first embodiment will be described. FIG. 4 schematically illustrates the configuration of the common high-voltage power source 71 according to the first embodiment.

The common high-voltage power source 71 is capable of outputting voltage from a charging high-voltage terminal 71*a* connected to the charging roller 12 and a developing blade high-voltage terminal 71*b* connected to the developing blade 25. Provision of a power source common between the charging high-voltage terminal 71*a* and the developing blade high-voltage terminal 71*b*, achieves reduction in cost and miniaturization. The developing blade voltage is created by division of the charging voltage by a resistor R1 and a Zener diode ZD1 as voltage retaining elements. Note that, according to the first embodiment, the Zener diode ZD1 is used for creation of the developing blade voltage. However, instead of the Zener diode ZD1, for example, a resistor may be used for a voltage divider circuit.

Figure 5:
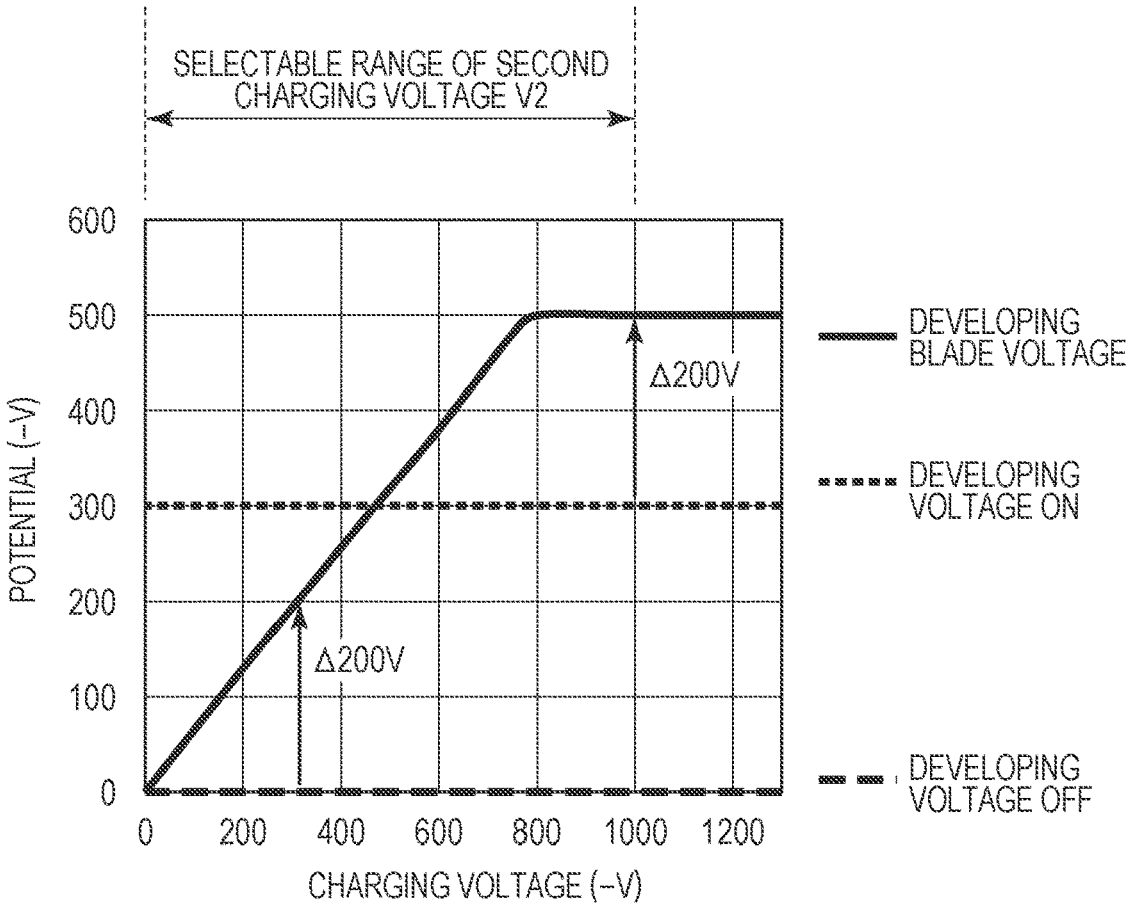
FIG. 5 illustrates the relationship between charging voltage and developing blade voltage, according to the first embodiment.

The voltage output characteristics of the common high-voltage power source 71 will be described with FIG. 5. FIG. 5 illustrates the relationship between the developing blade voltage and the developing voltage when the charging voltage varies. The developing blade voltage is clamped to a predetermined voltage by the Zener diode ZD1 to the charging voltage as described above. In a case where a charging voltage of a value or more (−800 V or more in the first embodiment) is applied, a voltage of −500 V can be applied as the developing blade voltage. That is, during image forming, the charging high-voltage terminal 71*a* outputs a charging voltage of −1000 V as the first charging voltage V1. Thus, the developing blade high-voltage terminal 71*b* outputs a voltage of −500 V. During image forming, the developing high-voltage power source 72 applies a voltage of −300 V to the developing roller 23. Thus, the developing blade 25 retains a potential higher by 200 V than that of the developing roller 23, resulting in acquisition of negative-charge-providing performance to the toner 22.

Meanwhile, in a case where the charging voltage is less than a value (−800 V in the first embodiment), because current that flows in the Zener diode ZD1 decreases, the developing blade voltage decreases below −500 V. Then, when the charging voltage is approximately −470 V, the developing blade voltage is −300 V equally to the developing voltage. When the charging voltage is approximately −310 V, the developing blade voltage is −200 V. Thus, in a case where the developing voltage is turned OFF, at a charging voltage of −310 V, negative-charge-providing performance identical to that in the image-forming period is acquired with the potential difference of the developing blade 25 to the developing roller 23 identical to that in the image-forming period.

4. Example Voltage Control

Figure 6:
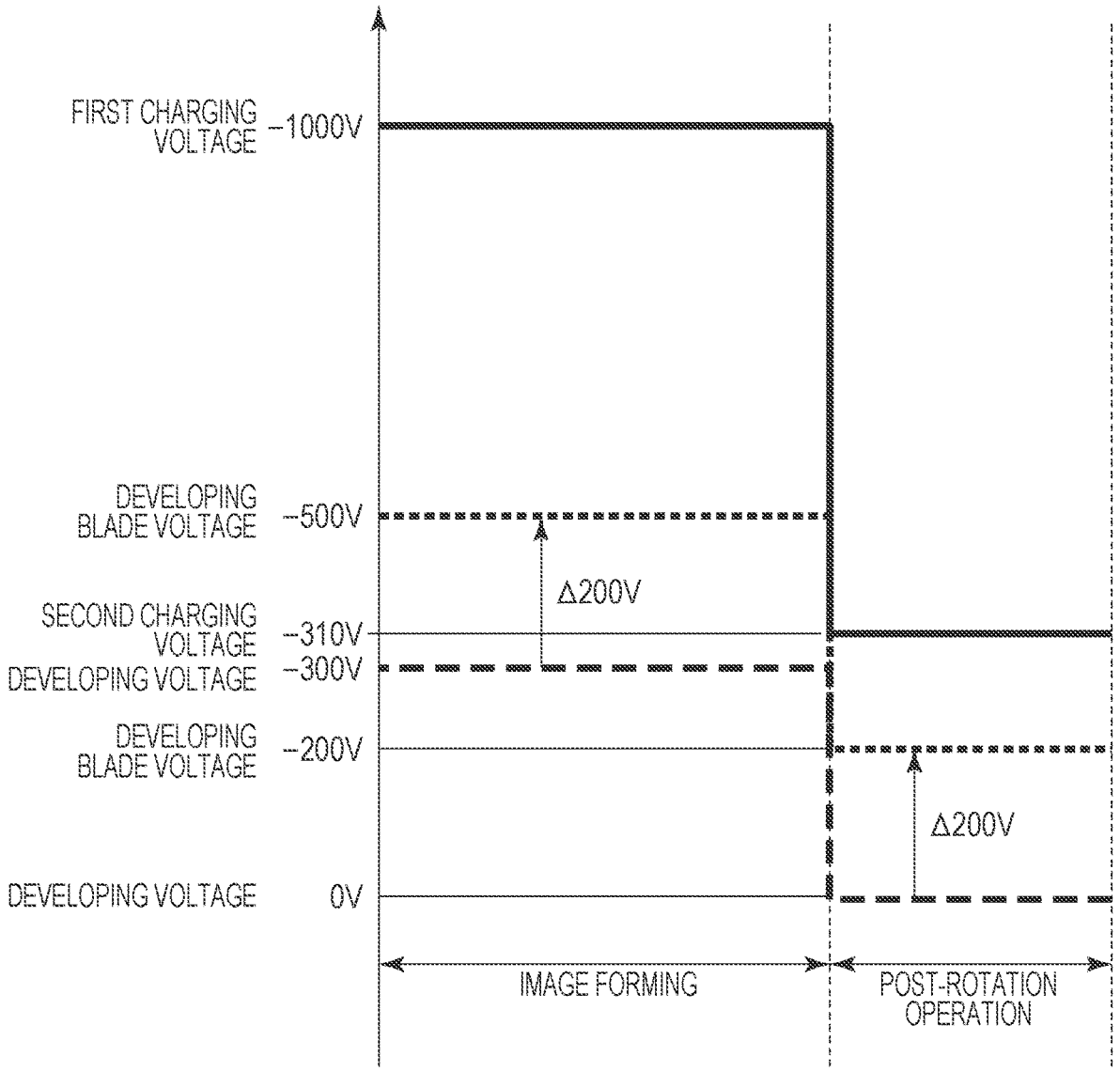
FIG. 6 illustrates the relationship in voltage between an image-forming period and a non-image-forming period, according to the first embodiment.

FIG. 6 illustrates output voltages of high-voltage power sources in the image-forming operation and the post-rotation operation of the image forming apparatus 100.

During image forming, the image forming apparatus 100 applies a voltage of −1000 V as the first charging voltage V1, to the charging roller 12, to retain the developing blade voltage at −500 V, so that the potential difference Δ of the developing blade voltage to the developing voltage is 200 V. Note that, in a post-rotation operation period, no image forming is performed, and the drive of the developing roller 23 and the photoconductive drum 11 continues to reset the respective surface conditions thereof. Thus, the surface potential of the photoconductive drum 11 requires no retaining at a constant value. Preferably, discharging is inhibited as much as possible between the photoconductive drum 11 and the charging roller 12. Because the developing roller 23 is spaced apart from the photoconductive drum 11, the developing voltage requires no applying. Thus, ordinarily, the developing voltage is 0 V.

According to the first embodiment, in a non-image-forming period including the post-rotation operation period, second charging voltage V2 lower than the first charging voltage V1 is applied in order to inhibit the photoconductive drum 11 from deteriorating due to discharging. At a second charging voltage V2 of −310 V, even with the developing voltage at 0 V, negative-charge-providing performance to the toner 22 due to the developing blade 25 is retained, similarly in the image-forming period. That is the potential difference Δ between the developing roller 23 and the developing blade 25 is 200 V. That is use of the second charging voltage V2 smaller than the discharge start voltage in the post-rotation operation period, enables retention of negative-charge-providing performance to the toner 22 due to the developing blade 25, without discharging to the photoconductive drum 11.

Figure 7:
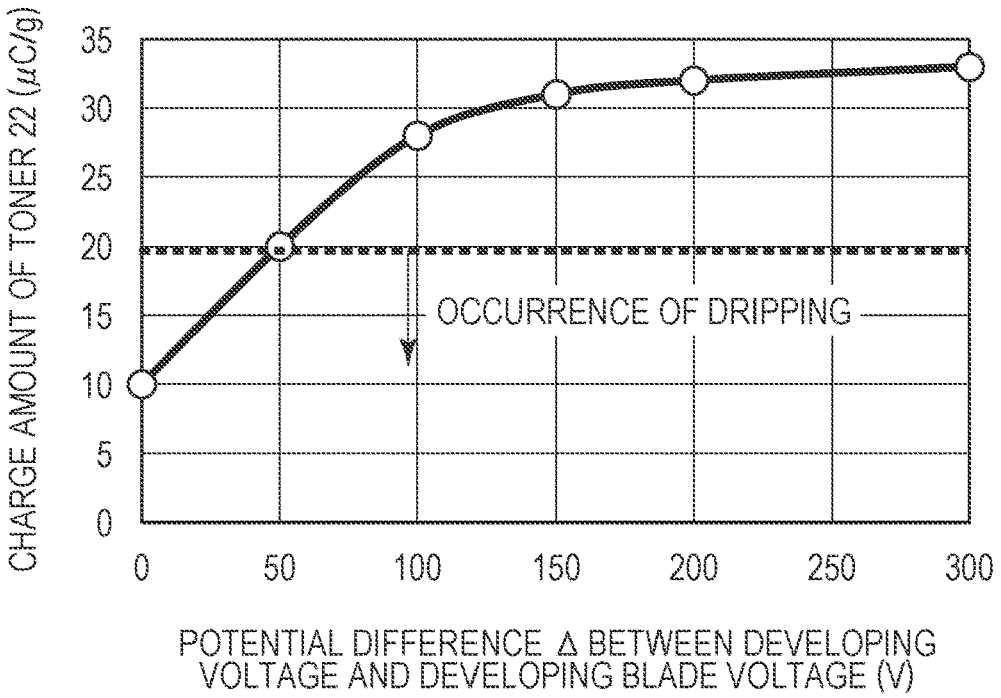
FIG. 7 illustrates the potential difference between developing voltage and the developing blade voltage, and the charge amount of toner, according to the first embodiment.

Here, FIG. 7 illustrates the relationship between the potential difference Δ between the developing voltage and the developing blade voltage and negative-charge-providing performance to be imparted to the toner 22, according to the first embodiment. The horizontal axis indicates the potential difference Δ between the developing voltage and the developing blade voltage, and the vertical axis indicates the charge amount of the toner 22 that is the value of negative-charge-providing performance of the toner 22. The charge amount of the toner 22 is the charge amount per unit mass of the toner 22 formed on the surface of the developing roller 23.

For measurement of the charge amount of the toner 22, the image-forming operation is forcibly terminated midway therethrough in the image forming apparatus 100, and then the toner 22 that has passed the developing blade 25 and has not been developed to the photoconductive drum 11, is measured from the toner 22 with which the surface of the developing roller 23 is coated. With a device equipped with a suction device having a filter that stems the toner 22 into a Faraday cage, as a measuring instrument for the charge amount, the weight and the charge amount of sucked toner 22 are measured and calculated. The charge amount of the toner 22 is measured while the Zener voltage of the Zener diode ZD1 is being varied.

Referring to FIG. 7, an increase in the charge amount of the toner 22 can be found even when the potential difference Δ between the developing voltage and the developing blade voltage is slight. This is because formation of an electric field between the developing roller 23 and the developing blade 25 causes negative charge to move to the toner 22 when the developing blade 25 and the toner 22 come in contact. The gradient of increase in the charge amount of the toner 22 to the potential difference Δ between the developing voltage and the developing blade voltage, decreases from approximately a potential difference of 100 V. Then, the charge amount of the toner 22 is saturated at a constant value.

As a result, in order to secure negative-charge-providing performance to the toner 22 in the configuration according to the first embodiment, any voltage higher than 0 V and lower than −1000 V can be selected as the second charging voltage V2 that is the charging voltage in the non-image-forming period.

Therefore, preferably, the range of the second charging voltage V2 satisfies the following expression:

$$V1(V)<V2(V)<0(V) \qquad \text{Expression (1)}$$

In that case, because the developing voltage is 0 V, the developing blade voltage can be retained always higher than the developing voltage. Furthermore, satisfaction of the following expression enables, even in the non-image-forming period, provision of the negative-charge-providing performance to the toner 22 similar to that in the image-forming period:

$$V1(V)<V2(V)\leq-310(V) \qquad \text{Expression (2)}$$

Figure 8:
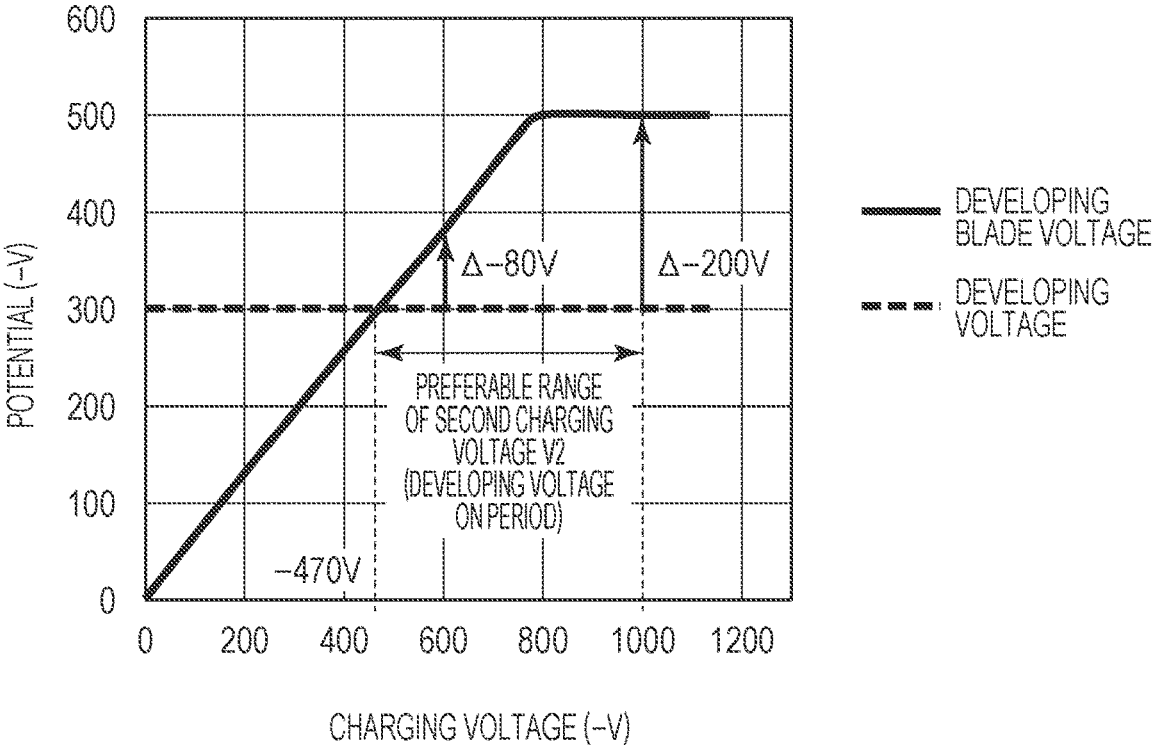
FIG. 8 illustrates the relationship between the charging voltage and the developing blade voltage, with the developing voltage applied, according to the first embodiment.

According to the first embodiment, the example in Which the developing voltage is OFF during the post-rotation operation, has been described. However, the present disclosure can be also applied even in a case where the developing voltage is ON during the post-rotation operation. Particular examples of the case include a case where the developing voltage is fixed at a fixed voltage and a case where the power source for the developing voltage is commonalized, to be described below. The developing voltage is determined from the relationship between the dark potential (Vd) and the light potential (V1) when image forming is performed. According to the first embodiment, the developing voltage is −300 V. In that case, as illustrated in FIG. 8, the second charging voltage V2 larger than −470 V enables the developing blade voltage to be higher than the developing voltage. That is any voltage higher than −470 V and lower than −1000 V can be selected as the second charging voltage V2. For example, selection of −600 V as the second charging voltage V2 enables inhibition of discharging to the photoconductive drum 11, retention of the developing blade voltage higher by 80 V than the developing voltage, and retention of negative-charge-providing performance to the toner 22 due to the developing blade 25 even during the post-rotation operation.

The developing voltage at −300 V in the first embodiment is example. Thus, in a case where the developing voltage is changed, preferably, the second charging voltage V2 is set in accordance with FIGS. 7 and 8. For example, when the developing voltage is set at −200 V, the second charging voltage V2 higher than −300 V enables retention of the state that the potential difference between the developing blade voltage and the developing voltage is present. Here, when the developing voltage is set above −370 V, the second charging voltage V2 requires setting at the discharge start voltage (−540 V) or more at lowest. Even in that case, because the charging voltage lower than the first charging voltage V1 can be selected, discharging can be inhibited. However, preferably, the second charging voltage V2 is selected in the condition that the charging voltage not more than the discharge start voltage can be selected.

5. Example Developer Dripping

As illustrated in FIG. 2, the developer container 21 includes a sheet member 29 that is a toner sealing member having elasticity, in contact with the developing roller 23, the sheet member 29 sealing the toner 22 inside the developer container 21 such that the toner 22 does not leak outside. In a case where the friction charge of the toner 22 having been thin-layered is insufficient, the frictional force between the toner 22 and the sheet member 29 is stronger than the image force between the toner 22 and the developing roller 23. Thus, the toner 22 is swept, so that the toner 22 drops from the developing roller 23. This phenomenon is called dripping. Therefore, the level of dripping varies depending on the friction charge due to rubbing between the developing roller 23 and the developing blade 25. Occurrence of dripping causes the toner 22 to drop onto the photoconductive drum 11 or a recording medium S, resulting in occurrence of adverse effect on an image.

Table 1 indicates the relationship between the charge amount of the toner 22 on the developing roller 23 and dripping. The degree of dripping is evaluated with variation of the charge amount of the toner 22 by variation of the Zener voltage of the Zener diode ZD1, similarly to the measurement for the result illustrated in FIG. 7.

TABLE 1

| | Charge amount of toner 22 (μC/g) | | | | |
|---|---|---|---|---|---|
| | 10 | 15 | 20 | 25 | 30 |
| Level of dripping | X | X | ○ | ○ | ○ |

For the level indicated in Table 1, ○ represents no occurrence of soiling of the toner 22 on a recording medium S, x and represents occurrence of soiling of the toner 22 on a recording medium S.

From a result of the evaluation, it can been found that, in the configuration according to the first embodiment, the charge amount of the toner 22 at 20 μC/g or more enables sufficient securing of the image force between the toner 22 and the developing roller 23, resulting in no occurrence of dripping. Therefore, from the respective results of FIG. 7 and Table 1, the potential difference Δ between the developing blade voltage and the developing voltage, at 50 V or more causes the charge amount of the toner 22 to be 20 μC/g. Thus, dripping can be inhibited favorably.

6. Adverse Effect on Image Due to Discharging to Photoconductive Drum

Before image forming, typically, the image forming apparatus 100 performs a preprocessing operation (so-called pre-rotation operation) to make a preparation such that, for example, the developing device 20 and the photoconductive drum 11 are suitably ready for image forming. After image forming, typically, the image forming apparatus 100 performs a postprocessing operation (so-called post-rotation operation) to make a reset such that image forming is ready to perform promptly favorably, with movement of the toner 22 remaining in places to an appropriate place. In the pre-rotation operation and the post-rotation operation, separation of the developing roller 23 from the photoconductive drum 11 enables inhibition of unintended consumption of the toner 22 (so-called fog).

However, in a case where the charging voltage similar to that in the image-forming period is applied in the pre-rotation operation or the post-rotation operation, consecutive discharging is performed to the photoconductive drum 11, so that the surface layer of the photoconductive drum 11 deteriorates due to abrasion or adhesion of corona products. When corona products adhere to the surface of the photoconductive drum 11, image smearing is likely to occur by reaction with moisture in air. In addition, when the coefficient of friction of the surface of the photoconductive drum 11 rises, unusual noise occurs due to chattering vibration of a member abutting on the photoconductive drum 11, particularly, the cleaning blade 14. When unusual noise occurs in the cleaning blade 14 and the coefficient of friction further rises, the cleaning blade 14 cannot retain the stable abutting condition with the photoconductive drum 11. Thus, a phenomenon occurs in which the cleaning blade 14 is turned up.

The discharging amount to the photoconductive drum 11 is determined by the potential difference between the charging voltage and the after-transferring potential of the photoconductive drum 11. Reception of the transfer voltage having positive polarity causes the after-transferring potential of the photoconductive drum 11 to attenuate to the dark potential Vd after charging. The after-transferring potential does not vary much regardless of the value of the dark potential Vd after charging. Thus, the discharging amount almost depends on the charging voltage. Therefore, as the charging voltage increases, the influence of discharging increases.

7. Effect in Non-Image-Forming Operation

Next, in performance of a non-image-forming operation, effect verification is performed at each changed charging voltage. Table 2 indicates inhibition effect on deterioration of the photoconductive drum 11 due to discharging and dripping at each set charging voltage value.

As Comparative Example 1, in a case where the charging voltage to be applied in the non-image-forming period is 0 V, and as Comparative Example 2, in a case where the charging voltage to be applied in the non-image-forming period is −1000 V the same as that in the image-forming period, effect verification is performed similarly. For the effect verification, the image-forming operation is performed with the image forming apparatus 100. Then, the charging voltage to be applied is varied in the post-rotation operation, and then the level of influence of discharging to the photoconductive drum 11 and the level of dripping to a recording medium S are verified.

TABLE 2

| | Charging voltage | Influence of discharging | Dripping |
|---|---|---|---|
| Comparative example 1 | 0 V | ○ | X |
| Comparative example 2 | −1000 V (V1) | X | ○ |
| First embodiment | −310 V (V2) | ○ | ○ |

For the level indicated in Table 2, o represents no influence of discharging or no occurrence of dripping, and x represents influence of discharging or occurrence of dripping.

According to Comparative Example 1, because no discharging is performed to the photoconductive drum 11 at a charging voltage of 0 V, the photoconductive drum 11 can be inhibited from deteriorating due to discharging. However, toner dripping occurs. In this respect, it can be considered that the following phenomenon occurs in the configuration according to the first embodiment in which a power circuit is commonalized so as to output the charging voltage to be applied to the charging roller 12 that charges the surface of the photoconductive drum 11 and the developing blade voltage to be applied to the developing blade 25. In a case where no charging voltage is applied in the non-image-forming period, no developing blade voltage is applied to the developing blade 25. Thus, no charge is suppled from the developing blade 25 to the toner 22, so that dripping is difficult to inhibit due to friction charge shortage of the toner 22. Therefore, for inhibition of toner dripping, the state that the charging voltage is applied to some extent, requires retaining to secure the potential difference Δ between the developing blade 25 and the developing roller 23.

Meanwhile, as in Comparative Example 2, when the charging voltage is a first charging voltage V1 of −1000 V in the image-forming period, the potential difference Δ of the developing blade voltage to the developing voltage is sufficiently acquired. Thus, toner dripping can be inhibited. However, because discharging is performed to the photoconductive drum 11, similarly in the image-forming period, the photoconductive drum 11 deteriorates due to the discharging.

Thus, as in the first embodiment, when the charging voltage is a second charging voltage V2 of −310 V, no discharging is performed to the photoconductive drum 11. Furthermore, the photoconductive drum 11 can be inhibited from deteriorating due to discharging, and the potential difference Δ of the developing blade voltage to the developing voltage can be acquired. Thus, toner dripping can be inhibited.

According to the first embodiment, the second charging voltage V2 is −310 V. However, the second charging voltage V2 is not limited to this, and thus requires at least to be a value lower than −1000 V as the first charging voltage V1 and higher than 0 V. However, when the second charging voltage V2 is higher than the discharge start voltage, as described above, discharging occurs not a little to the photoconductive drum 11, resulting in acceleration of deterioration of the photoconductive drum 11 due to discharging. Therefore, more preferably, the second charging voltage V2 requires at least to be higher than 0 V and lower than the discharge start voltage. Furthermore, increase of the potential difference Δ between the developing roller 23 and the developing blade 25 enables increase of the charge amount of the toner 22. Thus, preferably, the second charging voltage V2 to be applied is higher in a range in which no discharging is performed, near the discharge start voltage. That is, according to the first embodiment, as setting for no discharging, the charging voltage requires selecting at least such that a potential difference Δ of 200 V is acquired.

To summarize, the image forming apparatus 100 according to the first embodiment has the following configuration. Provided are the photoconductive drum 11 rotatable and the charging roller 12 that charges the surface of the photoconductive drum 11. The common high-voltage power source 71 that applies the charging voltage, applies the charging voltage to the charging roller 12 so that discharging is performed to the photoconductive drum 11. Then, while being rotated by a drive unit, the developing roller 23 cavies the toner 22 having negative polarity as the normal polarity. After the developing blade 25 regulates the toner 22, the developing roller 23 supplies the toner 22 onto the surface of the photoconductive drum 11, resulting in development of a toner image. In that case, the common high-voltage power source 71 that is a common voltage applying unit, applies voltage to the charging roller 12 and the developing blade 25, to cause the potential difference Δ between the developing blade 25 and the developing roller 23. The control unit 202 controls the drive unit and the common high-voltage power source 71 for formation of potential difference in a direction in which electrostatic force from the developing blade 25 to the developing roller 23 acts on the toner 22 charged in the normal polarity. That is the common high-voltage power source 71 is controlled such that the surface potential of the developing blade 25 has polarity identical to the negative polarity as the normal polarity and is larger in absolute value than the surface potential of the developing roller 23. Then, with the developing roller 23 rotating, the voltage to be applied to the charging roller 12 in the non-image-forming period including no image forming is controlled so as to be smaller in absolute value than the voltage to be applied to the charging roller 12 in the image-forming period.

As described above, even in a case where the common high-voltage power source 71 is provided for the charging high-voltage terminal 71*a* and the developing blade high-voltage terminal 71*b*, appropriate setting of the charging voltage in the non-image-forming period enables the photoconductive drum 11 to be inhibited from deteriorating due to discharging and enables toner dripping from the developing roller 23 to be inhibited.

The difference between an image forming apparatus 200 according to a second embodiment and the image forming apparatus 100 according to the first embodiment, will be only described. The same members are denoted with the same reference signs, and the descriptions of similar parts will be omitted.

Figure 9:
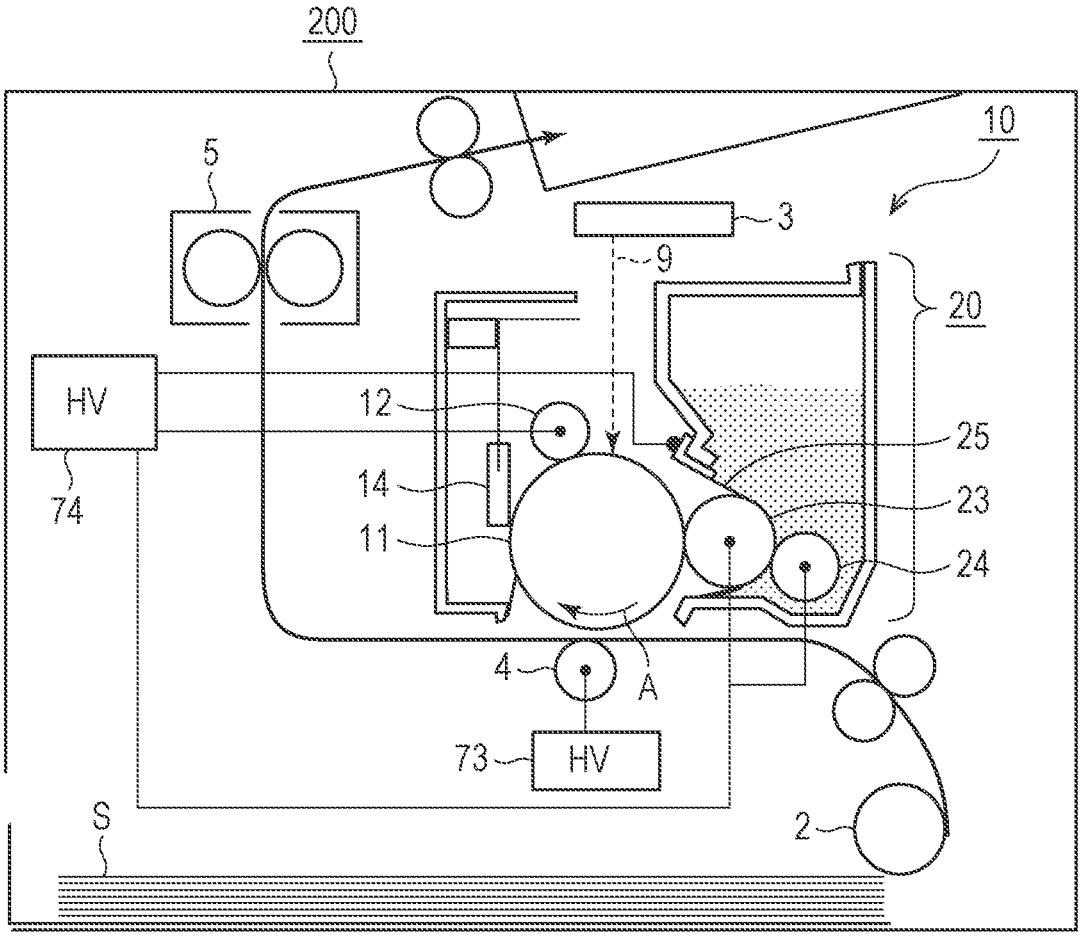
FIG. 9 illustrates the configuration of an image forming apparatus according to an example second embodiment.

FIG. 9 schematically illustrates the configuration of the image forming apparatus 200 according to the embodiment of the present disclosure, in section, in which each constituent is simply illustrated.

1. Configuration of High-Voltage Power Source

Figure 10:
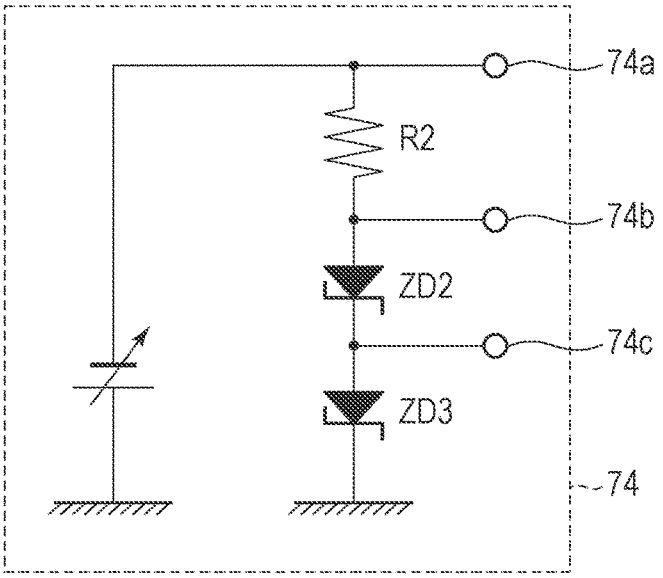
FIG. 10 illustrates the configuration of a high-voltage power source according to the second embodiment.

The image forming apparatus 200 includes a common high-voltage power source 74 illustrated in FIG. 10. The common high-voltage power source 74 includes a charging high-voltage terminal 74*a* connected with a resistor R2, a Zener diode ZD2, and a Zener diode ZD3 as voltage retaining elements. The charging high-voltage terminal 74*a* is connected with a charging roller 12. A developing blade high-voltage terminal 74*b* is connected with a developing blade 25. A developing high-voltage terminal 74*c* is connected with a developing roller 23. Provided is a power source common between three terminals of the charging high-voltage terminal 74*a*, the developing blade high-voltage terminal 74*b*, and the developing high-voltage terminal 74*c*, resulting in further reduction in cost and miniaturization than the common high-voltage power source 71 used in the configuration according to the first embodiment.

Figure 11:
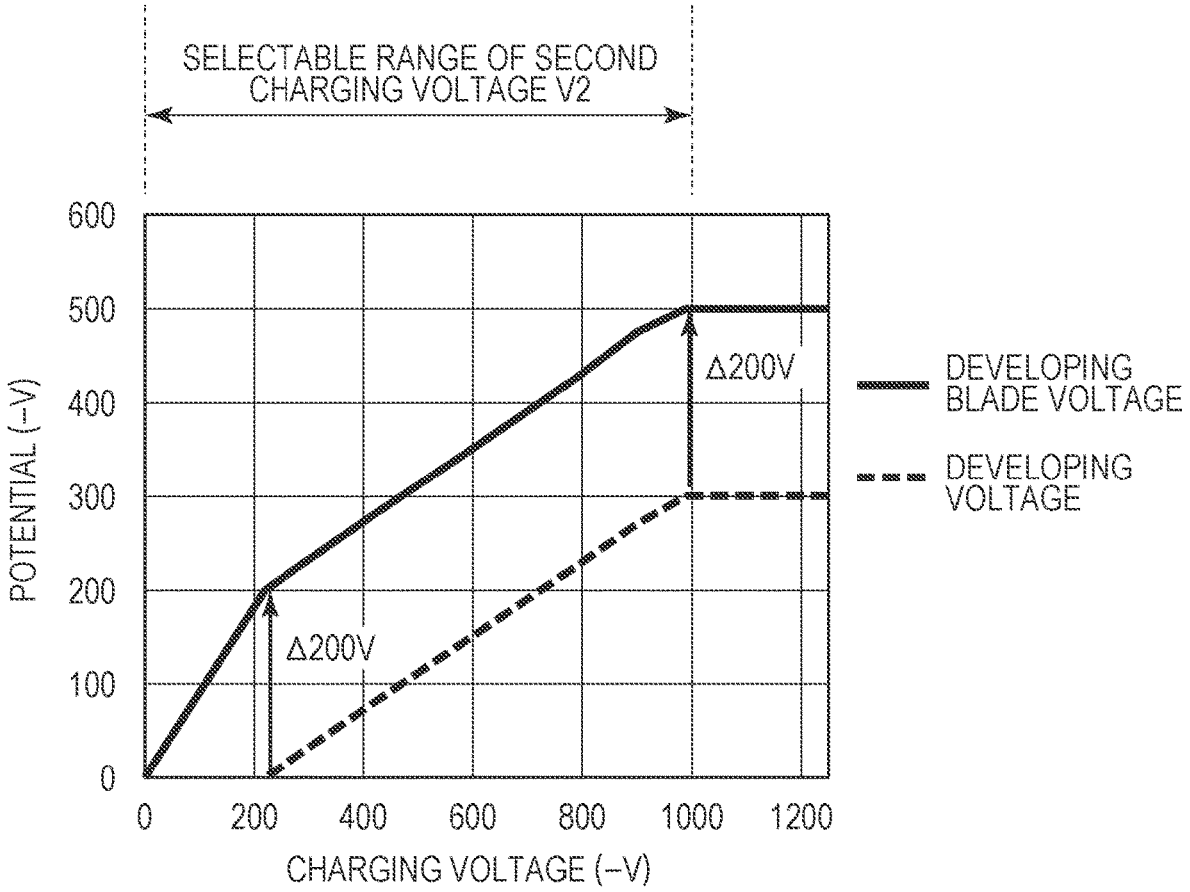
FIG. 11 illustrates the relationship between charging voltage and developing blade voltage, according to the second embodiment.

The voltage output characteristics of the common high-voltage power source 74 will be described with FIG. 11. FIG. 11 illustrates the respective variations of developing blade voltage and developing voltage when charging voltage varies in the common high-voltage power source 74. In the common high-voltage power source 74 according to the second embodiment, the Zener diode ZD2 and the Zener diode ZD3 each are capable of clamping a desired voltage when the charging voltage is higher than −990 V. The developing blade voltage can be retained at −500 V, and the developing voltage can be retained at −300 V. This is because current hardly flows due to highly resistive toner 22 interposed between the developing blade 25 and the developing roller 23, and the Zener diode ZD2 retains a desired Zener voltage. In an image-forming period, because a voltage of −1000 V is applied as first charging voltage V1, the developing blade voltage is −500 V and the developing voltage is −300 V. In this case, the developing blade voltage is higher by 200 V that is a predetermined potential difference than the developing voltage, resulting in acquisition of charge-providing performance from the developing blade 25 to the toner 22.

When the charging voltage ranges from −220 V to −990 V, current that flows in the Zener diode ZD3 decreases, so that the developing voltage decreases. In this case, although the developing blade voltage decreases similarly, the voltage of the Zener diode ZD2 is retained. Thus, the developing blade voltage can be retained higher by 200 V than the developing voltage. Then, when the charging voltage is −220 V, the developing voltage is approximately 0 V, and the developing blade voltage is −200 V.

2. Example Voltage Control

Next, voltage control of the common high-voltage power source 74 will be described. During image forming, the image forming apparatus 200 applies a voltage of −1000 V as the first charging voltage V1 to the charging roller 12, to retain the developing blade voltage at −500 V and to retain the developing voltage at −300 V. This arrangement causes the potential difference Δ of the developing blade voltage to the developing voltage, to be 200 V.

Meanwhile, in a post-rotation operation period, no image forming is performed, and the drive of the developing roller 23 and a photoconductive drum 11 continues to reset the respective surface conditions thereof. Thus, the surface potential of the photoconductive drum 11 requires no retaining at a constant value. Because no image forming is performed in the post-rotation operation period, the developing roller 23 is spaced apart from the photoconductive drum 11, and the developing voltage requires no applying. Thus, the developing voltage can be set at 0 V. However, according to the second embodiment, if no charging voltage is applied in the post-rotation operation period, the potential difference Δ between the developing blade voltage and the developing voltage cannot be secured. Thus, similarly to the first embodiment, in the post-rotation operation period, second charging voltage V2 smaller in absolute value than the first charging voltage V1 is applied in order to inhibit the photoconductive drum 11 from deteriorating due to discharging. As illustrated in FIG. 11, application of the charging voltage causes application of the developing blade voltage. Thus, in a case where the charging voltage to be applied is higher in absolute value than 0 V and lower in absolute value than −1000 V, the charging voltage can be selected as the second charging voltage V2. Particularly, the region in which the charging voltage is higher than −220 V enables the potential difference Δ between the developing blade voltage and the developing voltage, to be 200 V. Thus, negative charge provision to the toner 22 can be accelerated, similarly in the image-forming period.

Even in a case where the common high-voltage power source outputs the charging voltage, the developing blade voltage, and the developing voltage, the charging voltage to be applied to the charging roller 12 in the non-image-forming period is set to the second charging voltage V2. Thus, toner dripping can be inhibited with inhibition of the photoconductive drum 11 from deteriorating due to discharging.

According to a third embodiment, control of changing the condition of second charging voltage V2 that is charging voltage to be applied in a non-image-forming period, is performed. Specifically, when a cleaning operation is performed to toner 22 or an external additive adhering to a charging roller 12, control of applying third charging voltage V3 is performed. According to the third embodiment, the image forming apparatus 200 illustrated in FIG. 9 is used, having the configuration according to the second embodiment. Note that use of the image forming apparatus 100 illustrated in FIG. 1, having the configuration according to the first embodiment, enables a similar effect to be acquired.

1. Cleaning Operation Control

First, control of the cleaning operation to the charging roller 12 according to the third embodiment will be described. Repetition of image forming by the image forming apparatus 200 causes extraneous matter to adhere to the charging roller 12, in some cases. As a result, adverse effect on an image occurs due to a charging failure. Thus, the extraneous matter adhering to the charging roller 12 requires cleaning in the non-image-forming period. Here, examples of the extraneous matter to be cleaned include the toner 22 having passed a cleaning blade 14 and the external additive having separated from the surface of the toner 22. The toner 22 has negative chargeability. However, in some cases, due to contact in the toner 22 or discharging at a transfer portion, charging occurs in positive polarity that is the inversion polarity (reverse polarity) of negative polarity as normal polarity. Thus, the extraneous matter charged in positive polarity and the extraneous matter charged in negative polarity are likely to adhere to the charging roller 12. Thus, the cleaning operation of removing the extraneous matter charged in positive polarity and the extraneous matter charged in negative polarity, having adhered to the charging roller 12, requires performing. In the cleaning operation, in order to clean the extraneous matter charged in positive polarity and the extraneous matter charged in negative polarity, voltage is controlled such that the charging roller 12 has the following states to the surface potential of the photoconductive drum 11. The states include the state that the potential of the charging roller 12 is higher than the surface potential of the photoconductive drum 11 (first cleaning operation) and the state that the potential of the charging roller 12 is lower than the surface potential of the photoconductive drum 11 (second cleaning operation). With the states, the cleaning operation is performed. The cleaning operation is performed in the non-image-forming period. In the non-image-forming period according to the third embodiment, the state inside a developing device 20 is reset independently of image forming patterns, and the drive of the developing roller 23 continues such that image forming is ready to perform favorably in the next image forming. In that case, the developing roller 23 is spaced apart from the photoconductive drum 11 by a contact and separation unit 50.

Figure 12:
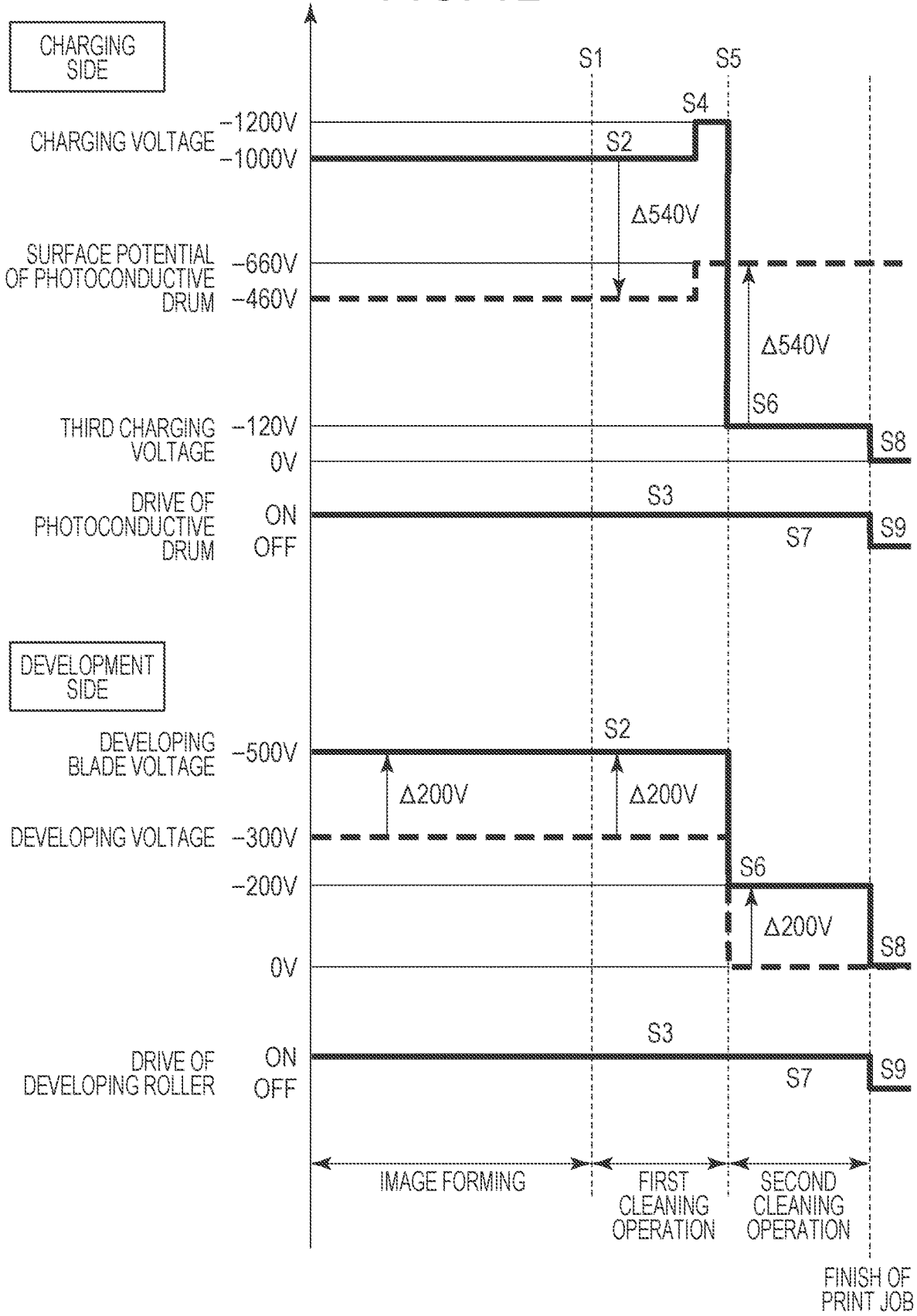
FIG. 12 illustrates the relationship in voltage between an image-forming period and a non-image-forming period, according to an example third embodiment.
Figure 13:
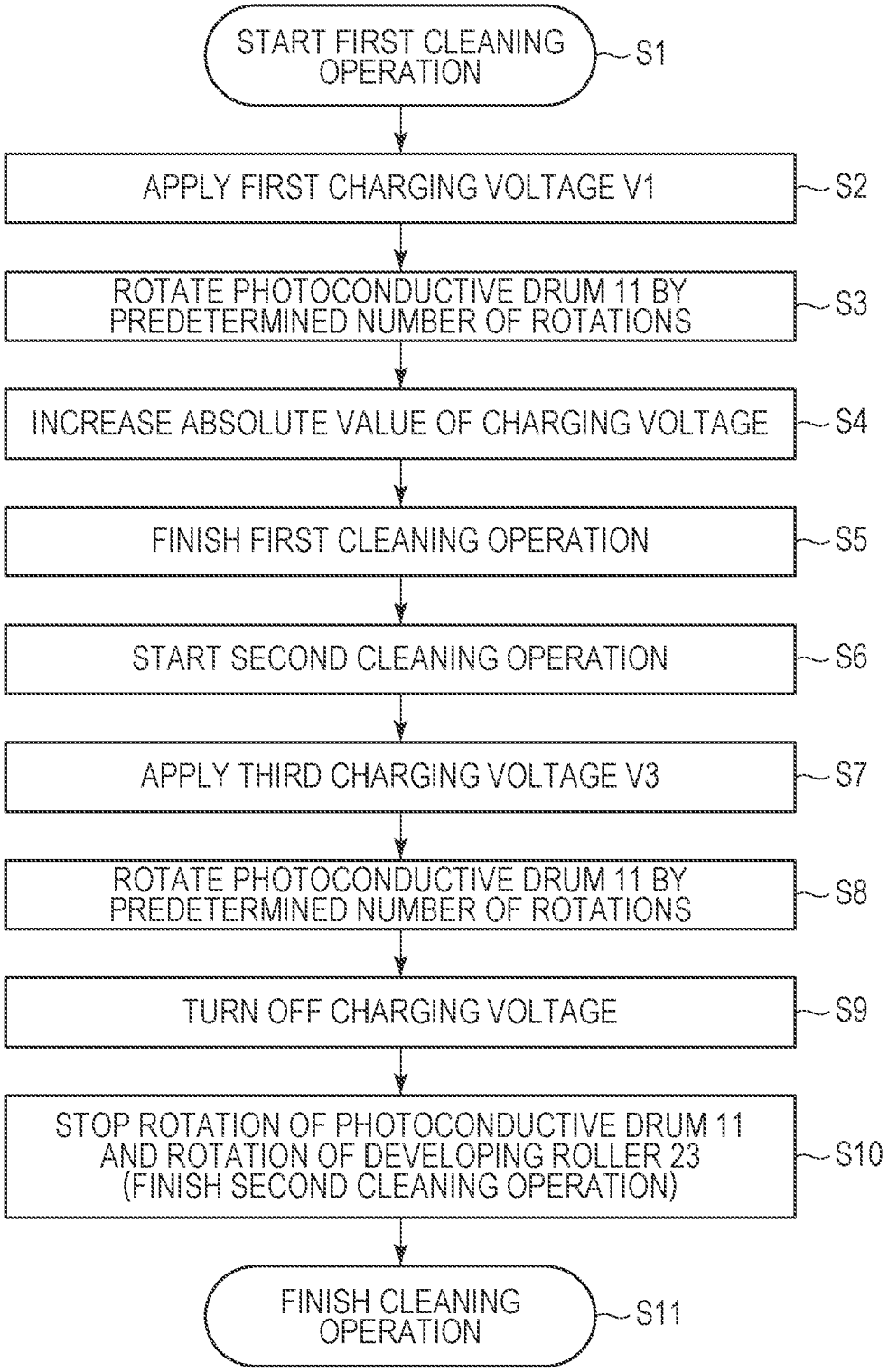
FIG. 13 is a flowchart of a cleaning operation according to the third embodiment.

The cleaning operation will be described with FIGS. 12 and 13. FIG. 12 illustrates the voltage applying states of the charging side and the development side during the cleaning operation. FIG. 13 is a flowchart of the cleaning operation. The cleaning operation performed after image forming as an example of the non-image-forming period, will be described.

First, after image forming finishes, the photoconductive drum 11 is driven for performance of the first cleaning operation (S1). Then, a voltage of −1000 V as the first charging voltage V1 is applied to the charging roller 12 (S2). In order to move the extraneous matter to the photoconductive drum 11, the photoconductive drum 11 is rotated by a desired number of rotations with the first charging voltage V1 applied (S3). After step S3, the charging voltage is varied to −1200 V higher than the first charging voltage V1 (S4), and then the first cleaning operation finishes (S5). After the first cleaning operation, the second cleaning operation starts (S6). In the second cleaning operation, the charging voltage is switched from −1200 V to −120 V as the third charging voltage V3 (S7). When the photoconductive drum 11 is driven rotationally by a predetermined number of rotations (S8), the cleaning blade 14 sweeps the extraneous matter charged in positive polarity, having moved to the photoconductive drum 11, so that the extraneous matter is removed from the photoconductive drum 11. Then, the output of the charging voltage is turned OFF (S9). The drive of the photoconductive drum 11 and the developing roller 23 is turned OFF, and then the second cleaning operation finishes (S10). Then, the cleaning operation finishes (S11).

Each step of the cleaning operation will be described in detail.

At step S2 in the first cleaning operation, in order to move the matter charged in negative polarity, adhering to the charging roller 12, to the photoconductive drum 11, the potential of the charging roller 12 requires to be higher than the surface potential of the photoconductive drum 11. Thus, a voltage of −1000 V identical to the first charging voltage V1 in the image-forming period, is consecutively applied to the charging roller 12 through the charging high-voltage terminal 74*a*, so that the potential of the charging roller 12 is retained higher by 540 V as discharge start voltage than the surface potential of the photoconductive drum 11. This arrangement causes the extraneous matter charged in negative polarity on the surface of the charging roller 12, to move to the photoconductive drum 11 with reception of electrostatic force.

At step S3, the photoconductive drum 11 is driven rotationally such that the cleaning blade 14 sweeps the extraneous matter charged in negative polarity, moved to the photoconductive drum 11 at step S2, so that the extraneous matter is removed from the photoconductive drum 11. Thus, the first cleaning operation is performed at least for the time period that the photoconductive drum 11 rotates from the charging portion contacting with the charging roller 12 to the cleaning portion contacting with the cleaning blade 14, in addition to the time period for one rotation of the charging roller 12, so that the entire circumference of the charging roller 12 can be cleaned. According to the third embodiment, in order to reliably secure a chance that the extraneous matter moves, the photoconductive drum 11 rotates by five rotations with a voltage of −1000 V applied to the charging roller 12 through the charging high-voltage terminal 74*a* in the first cleaning operation.

At step S4, increase of the charging voltage causes the surface potential of the photoconductive drum 11 to be −660 V. Thus, the surface potential of the photoconductive drum 11 is higher than that in the previous rotation. However, the potential difference to the charging roller 12 is constant at 540 V. According to the third embodiment, the charging voltage remains high during the time period that the photoconductive drum 11 rotates by one rotation. The charging voltage at −1200 V is effective in the second cleaning operation to be described below.

During the cleaning operation from step S1 to step S5, the drive of the developing roller 23 continues. However, because the charging voltage is −1000 V or −1200 V, as illustrated in FIG. 11, the developing blade voltage is retained at −500 V, and the developing voltage is retained at −300 V. Thus, the developing blade voltage is retained higher by 200 V in potential than the developing voltage, so that negative-charge-providing performance to the toner 22 due to the developing blade 25 is retained, similarly in the image-forming period.

At steps S6 and S7 in the second cleaning operation, in order to move the matter charged in positive polarity, adhering to the charging roller 12, to the photoconductive drum 11, desirably, the potential of the charging roller 12 is lower than the surface potential of the photoconductive drum 11. Thus, for the charging voltage to be applied in the second cleaning operation period, the following three points require considering.

Firstly, discharging requires inhibiting from occurring between the photoconductive drum 11 and the charging roller 12. In this respect, a voltage less than −540 V is preferable for no discharging from the charging roller 12 to the photoconductive drum 11. Furthermore, reverse discharging requires inhibiting from occurring to the surface potential formed on the surface of the photoconductive drum 11. This results from a fear that increase of the surface potential of the photoconductive drum 11 at a switch of the charging voltage to −1200 V before the second cleaning operation, causes reverse discharging from the photoconductive drum 11 to the charging roller 12 if the potential of the charging roller 12 is considerably low. Specifically, the charging roller 12 charged at −1200 V causes the surface potential formed on the surface of the photoconductive drum 11, to be −660 V. The potential difference at which discharging starts, requires setting below 540 V. Thus, preferably, the charging voltage is −120 V or more.

Secondly, negative-charge-providing performance to the toner 22 due to the developing blade 25, requires retaining. In this respect, as described above, preferably, the potential difference Δ between the developing blade 25 and the developing roller 23 is larger than 50 V, as illustrated in FIG. 7. Therefore, as illustrated in FIG. 11, preferably, the charging voltage is higher than −50 V. However, referring to FIG. 7, considering that formation of the potential difference Δ between the developing blade voltage and the developing voltage enables charge provision, as is clear from FIG. 11, application of the charging voltage causes at least the potential difference Δ to be formed. Therefore, the charging voltage higher than 0 V requires selecting at least.

Thirdly, the matter charged in positive polarity, adhering to the charging roller 12, requires moving to the photoconductive drum 11, efficiently. In this respect, preferably, the potential of the charging roller 12 is as low as possible to the surface potential of the photoconductive drum 11. In consideration of the above, when the charging voltage in the second cleaning operation according to the third embodiment is defined as the third charging voltage V3, conditions for the third charging voltage V3 are as follows:

$$|V3|<|V1| \quad \text{Expression (3)}$$

$$-540(V)\leq V3(V)\leq -120(V) \quad \text{Expression (4).}$$

Because −120 V is most preferable from the conditions for the third charging voltage V3, according to the third embodiment, −120 V is selected for the third charging voltage V3.

The switching in steps S6 and S7 causes no discharging to be performed from the charging roller 12 to the photoconductive drum 11. Thus, the surface potential of the photoconductive drum 11 is retained at −660 V. Then, the potential of the charging roller 12 is lower by 540 V than the surface potential of the photoconductive drum 11, so that the extraneous matter discharged in positive polarity, on the surface of the charging roller 12, moves to the photoconductive drum 11 with reception of electrostatic force. In a case where the charging voltage is −1000 V from beginning to end in the first cleaning operation, the potential of the charging roller 12 can be made lower only by 340 V than the surface potential of the photoconductive drum 11 (−460 V) in the second cleaning operation. Thus, the force of moving the matter charged in positive polarity to the photoconductive drum 11 weakens. Therefore, in order to move the matter charged in positive polarity to the photoconductive drum 11 efficiently in the second cleaning operation, the charging voltage is increased from −1000 V to −1200 V at step S4 in the first cleaning operation.

Similarly to the first cleaning operation, the second cleaning operation is performed at least for the time period that the photoconductive drum 11 rotates from the charging portion to the cleaning portion, in addition to the time period for one rotation of the charging roller 12. As a result, the entire circumference of the charging roller 12 can be cleaned. According to the third embodiment, in order to reliably acquire a chance that the extraneous matter moves, the photoconductive drum 11 rotates by six rotations.

Note that, according to the third embodiment, the number of rotations of the photoconductive drum 11 is set as the above, but the number of rotations may be varied, for example, in accordance with the degree of soiling of the charging roller 12. The first cleaning operation and the second cleaning operation may be switched in order. In that case, before the second cleaning operation starts, the surface potential of the photoconductive drum 11 requires to be higher than the first charging voltage V1 that is the charging voltage in the image-forming period. The charging voltage to be applied in the first cleaning operation is, but is not limited to, −1000 V as the first charging voltage V1 or −1200 V. Preferably, no discharging occurs between the photoconductive drum 11 and the charging roller 12 due to the third charging voltage V3 applied in the second cleaning operation, and the discharging voltage is appropriately changed such that a potential difference as large as possible is formed.

The timing at which the cleaning operation is performed, may be any timing at which the cleaning operation is performed in the non-image-forming period. For example, the cleaning operation may be performed not only in a post-rotation operation period after image forming finishes but also in a pre-rotation operation period before image forming starts.

3. Effect Verification

Table 3 indicates inhibition effect on deterioration of the photoconductive drum 11 due to discharging and dripping at each set charging voltage value in the cleaning operation to the charging roller 12.

As Comparative Example 1, in a case where the charging voltage to be applied in the non-image-forming period is 0 V, and as Comparative Example 2, in a case where the charging voltage to be applied in the non-image-forming period is −1000 V the same as that in the image-forming period, effect verification is performed similarly.

TABLE 3

| | Charging voltage | Influence of discharging | Dripping | Charging roller cleaning |
|---|---|---|---|---|
| Comparative example 1 | 0 V | ○ | X | ○ |
| Comparative example 2 | −1000 V (V1) | X | ○ | X |
| First embodiment | −310 V (V2) | ○ | ○ | X |
| Third embodiment | −120 V (V3) | ○ | ○ | ○ |

For the level indicated in Table 3, o represents no influence of discharging, no occurrence of dripping, or no occurrence of charging roller soiling after charging roller cleaning, and x represents influence of discharging, occurrence of dripping, or occurrence of charging roller soiling after charging roller cleaning.

According to Comparative Example 1, because no discharging is performed to the photoconductive drum 11 at a charging voltage of 0 V, the photoconductive drum 11 can be inhibited from deteriorating due to discharging. The potential difference to the surface potential of the photoconductive drum 11 is large in the charging roller cleaning, so that the charging roller cleaning can be performed favorably. However, toner dripping occurs.

Meanwhile, according to Comparative Example 2, because discharging is performed to the photoconductive drum 11 similarly in the image-forming period, the photoconductive drum 11 deteriorates due to the discharging. Furthermore, the potential difference to the photoconductive drum 11 cannot be appropriately set in the charging roller cleaning, so that no cleaning is performed.

As in the first embodiment, when the charging voltage is a second charging voltage V2 of −310 V, no discharging is performed to the photoconductive drum 11. However, the potential difference between the photoconductive drum 11 and the charging roller 12 is small in the charging roller cleaning. Therefore, the charging roller cleaning cannot be favorably performed.

Thus, according to the third embodiment, when the charging voltage is a third charging voltage V3 of −120 V, no discharging is performed at the photoconductive drum 11, and the potential difference between the photoconductive drum 11 and the charging roller 12 can be sufficiently secured in the charging roller cleaning. Therefore, the charging roller cleaning can be favorably performed. Furthermore, the potential difference Δ between the developing roller 23 and the developing blade 25 can be retained at 50 V or more, so that the charging roller cleaning can be favorably performed.

As described above, in a case where the common power source is provided for the charging voltage and the developing blade voltage, appropriate setting of the charging voltage in the charging roller cleaning enables the photoconductive drum 11 to be inhibited from deteriorating due to discharging, and enables toner dripping from the developing roller 23 to be inhibited.

According to the third embodiment, appropriate selection of the third charging voltage V3 in the second cleaning operation, enables the photoconductive drum 11 to be inhibited from deteriorating due to discharging and toner dripping to be inhibited, and enables the extraneous matter on the charging roller 12 to move to the photoconductive drum 11 efficiently.

According to a fourth embodiment, control of changing the condition of second charging voltage V2 that is charging voltage to be applied in a non-image-forming period, is performed, similarly to the third embodiment. Specifically, when an operation of detecting a brand-new developing device is performed, fourth charging voltage V4 is applied in voltage control performed in a case where a common power source is provided for a charging high-voltage terminal, a developing blade high-voltage terminal, and a developing high-voltage terminal.

1. Example Developing Device

Figure 14:
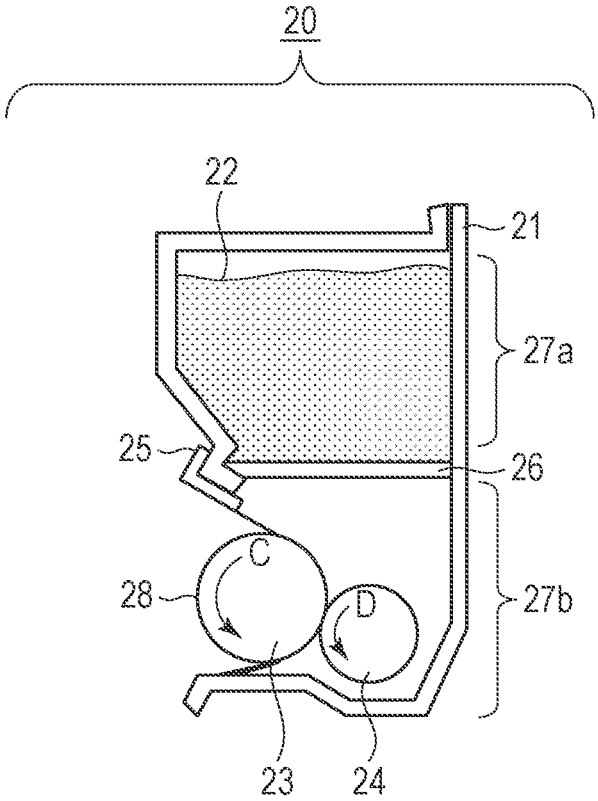
FIG. 14 illustrates the configuration of a developing device according to an example fourth embodiment.

First, the configuration of a brand-new developing device 20 will be described with FIG. 14 that is a sectional view of the developing device 20.

The developing device 20 includes a toner storage chamber 27*a* and a developing chamber 27*b* adjacent to each other. In the factory default state of the brand-new developing device 20, the toner storage chamber 27*a* and the developing chamber 27*b* are partitioned by a sealing member 26 adhering to a developer container 21, and thus toner 22 exists only in the toner storage chamber 27*a*. Removal of the sealing member 26 when use of a process cartridge 10 starts, causes one space of the toner storage chamber 27*a* and the developing chamber 27*b*. Thus, the toner 22 reaches a developing roller 23, so that development can be performed with the toner 22. Because the sealing member 26 is provided, in a distribution process in which the brand-new developing device 20 is shipped and delivered to a user, the user or the body of an image forming apparatus is prevented from being soiled with the toner 22 by scattering of the toner 22 from a gap at the opening portion of the developing chamber 27*b*. The sealing member 26 may be drawn out by the user to open the sealing before use. Alternatively, the sealing member 26 may be automatically drawn out at the timing at which the developing device 20 is driven after power is turned on to the image forming apparatus. According to the fourth embodiment, the user draws out.

The sealing member 26 prevents the toner 22 from scattering, whereas no toner 22 exists on the developing roller 23 in the unused state. Thus, significant torque is required in order to drive the developing roller 23 initially. When forcible driving is performed in that state, gears (not illustrated) that transmit driving are likely to break down, and additionally a developing blade 25 is likely to be turned up in the rotation direction of the developing roller 23 due to the friction between the developing roller 23 and the developing blade 25. In order to avoid the issues, according to the fourth embodiment, the brand-new developing roller 23 is coated in advance with a powder lubricant 28. Coating the surface of the developing roller 23 with the lubricant 28, enables reduction of the frictional force between the developing roller 23 and the developing blade 25 with no coating to the developing blade 25. According to the fourth embodiment, the surface of the developing roller 23 is coated with 30 mg of toner 22 as the lubricant 28. The coating is intended to reduce the frictional force between the developing roller 23 and the developing blade 25, and is small in amount for image forming. Note that the material, shape, charge amount, and amount of coating of the lubricant 28 are not limited to these, and thus should be appropriately selected in accordance with each type of constituent. The details of the lubricant 28 according to the fourth embodiment will be described. According to the fourth embodiment, powder for control of, for example, fluidity and environmental stability, is selected as the lubricant 28. Examples of the powder having those characteristics, include resin powder, namely, vinylidene fluoride impalpable powder and polytetrafluoroethylene impalpable powder. In addition, examples thereof include fatty acid metal salt, namely, zinc stearate, calcium stearate, and lead stearate. In addition, examples thereof include metallic oxide, namely, zinc oxide powder, silica, alumina, titanium oxide, and tin oxide. Furthermore, examples thereof include silica having a surface subjected to a silane coupler, a titanium coupler, or a silicone oil.

2. Brand-New Cartridge Detection

Figure 15:
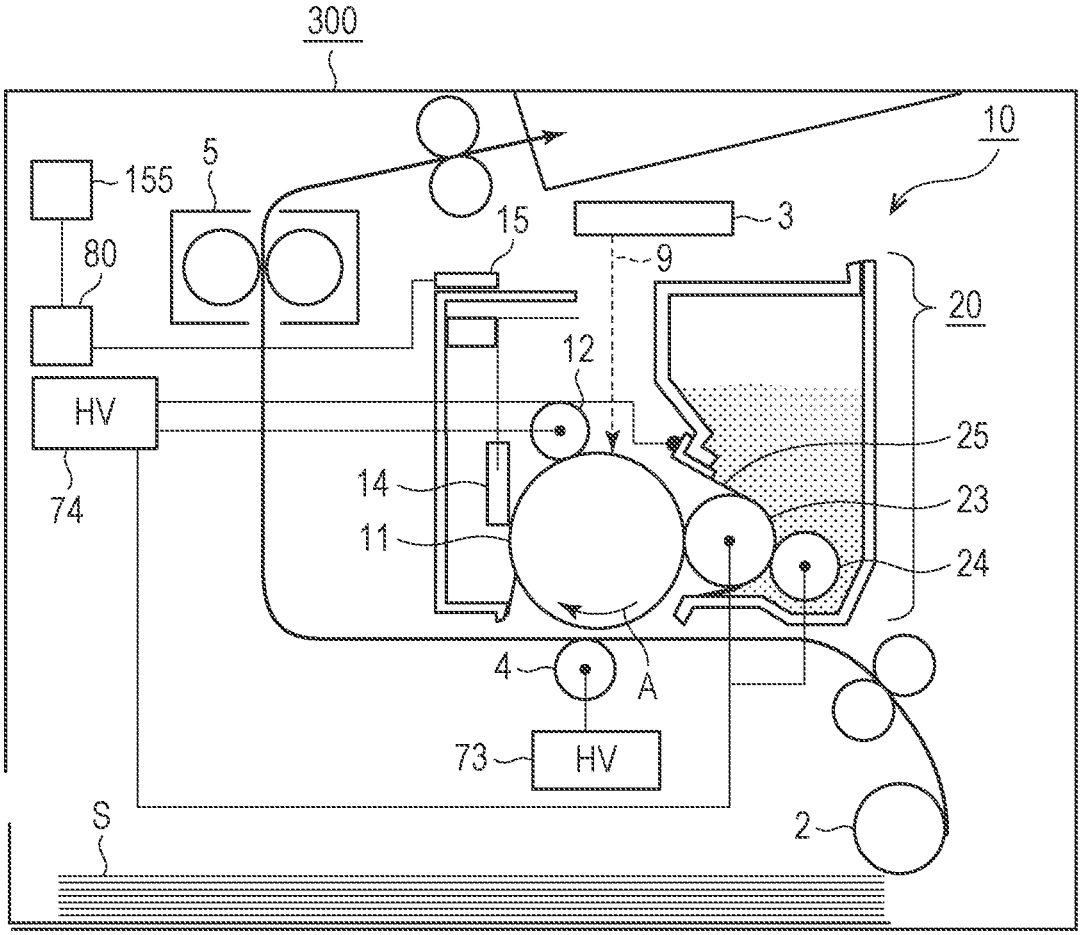
FIG. 15 illustrates the configuration of an image forming apparatus according to the fourth embodiment.

A method of detecting the usage history of the process cartridge 10 will be described with FIG. 15 illustrating an image forming apparatus 300.

The process cartridge 10 according to the fourth embodiment includes a memory 15 as a storage element capable of storing, for example, identification information regarding the process cartridge 10, the usage history of each type of member, and image process information. The image forming apparatus 300 includes a communication unit 80 that is a detection unit that sequentially communicates with the memory 15. Thus, reading of data in the memory 15 enables, for example, changing of operation or updating of data of the usage history written in the memory 15. The image forming apparatus 300 constantly grasps the latest state of the process cartridge 10 with the communication unit 80, so that optimum image forming can be performed.

According to the fourth embodiment, when the process cartridge 10 is inserted into the image forming apparatus 300, the communication unit 80 reads the data in the memory 15. Then, in a case where no usage history is present (operation history of the process cartridge 10), it is determined that the process cartridge 10 is brand-new.

In a case where it is determined that the process cartridge 10 is brand-new, by brand-new cartridge detection, the image forming apparatus 300 performs an initial setting operation.

In the brand-new state, the developing roller 23 is not sufficiently coated with the toner 22. Thus, a toner supplying roller 24 is soaked with the toner 22, so that the toner 22 can be steadily supplied onto the developing roller 23. This arrangement enables retention of a stable formation of toner coating on the developing roller 23.

Figure 16:
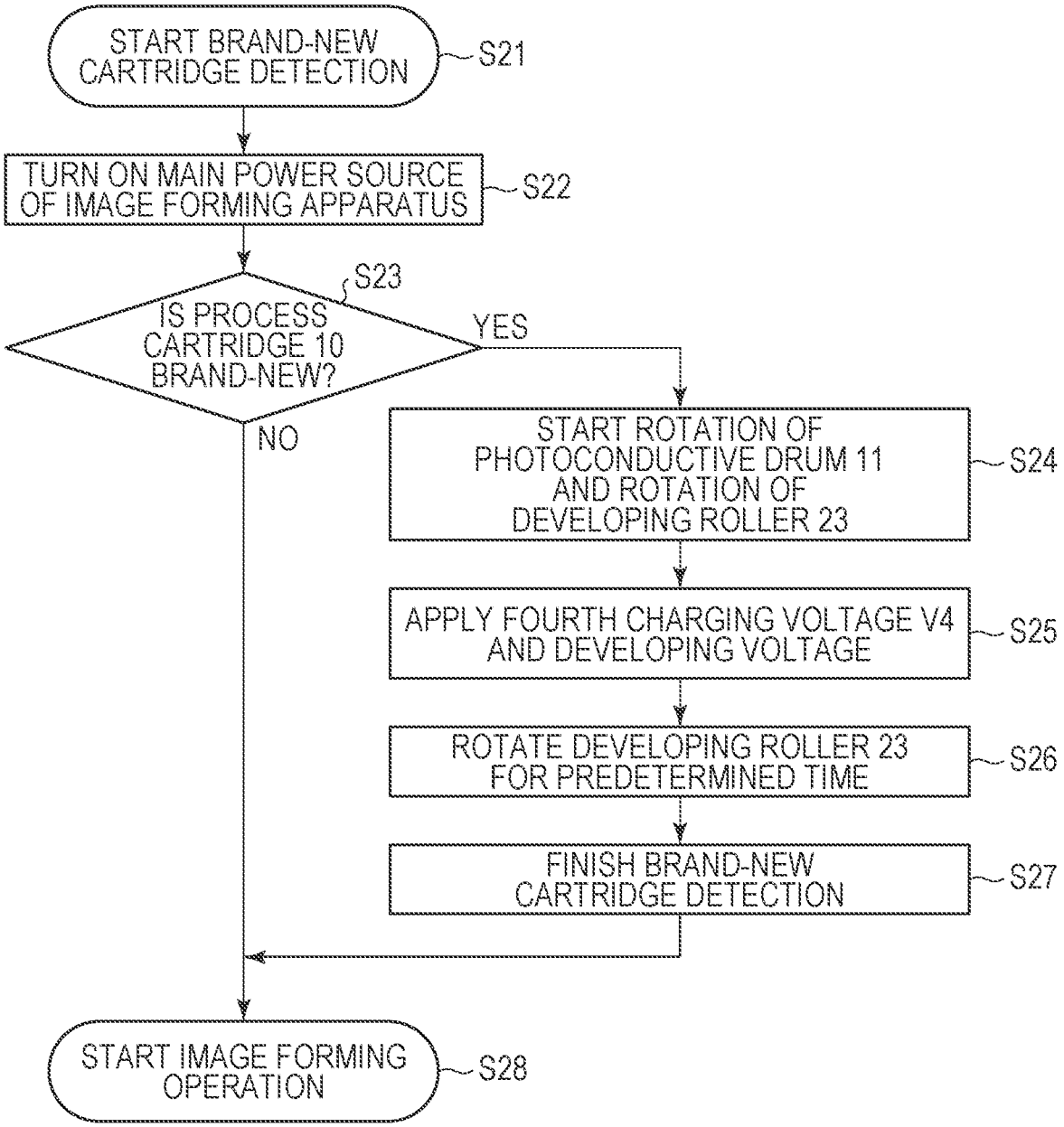
FIG. 16 is a flowchart of a brand-new cartridge detection operation according to the fourth embodiment.

A control flowchart from the brand-new cartridge detection to the initial setting operation, will be described with FIG. 16.

For start of the brand-new cartridge detection (S21), first, the main power source of the image forming apparatus 300 is turned ON (S22). After a brand-new process cartridge 10 is inserted, the brand-new cartridge detection is performed to determine whether the process cartridge 10 is brand-new (S23). In a case where it is determined that the process cartridge 10 is brand-new (Y), drive of a photoconductive drum 11 and drive of the developing roller 23 start (S24). The fourth charging voltage V4 to be described below is applied to a charging roller 12, and a voltage of −300 V is applied to the developing roller 23 (S25). After that, the developing roller 23 rotates for a predetermined time in order to soak the toner supplying roller 24 with the toner 22 (S26). After the rotation, the operation of the brand-new cartridge detection finishes (S27), and then the processing proceeds to image-forming preparation (S28). Meanwhile, at step S23, in a case where it is determined that the process cartridge 10 is not brand-new (N), the processing proceeds to the image-forming preparation, directly (S28).

At steps S24 to S26, for the process cartridge 10 determined as brand-new, the developing device 20 continues driving for 30 seconds after the drive of the developing roller 23 starts. This arrangement causes the toner supplying roller 24 to soak the toner 22 sufficiently, so that a stable formation of coating can be made on the developing roller 23. Through the process, the developing device 20 is ready for an ordinary image-forming operation. Thus, in the following process, the developing device 20 is controlled, similarly in the ordinary image-forming operation.

Note that the timing, time period, and applying voltage value of each operation in the initial setting operation are not limited to these, and thus should be appropriately selected in accordance with each type of constituent. As necessary, in order to reduce the frictional force between a cleaning blade 14 and the photoconductive drum 11, an operation of discharging the toner 22 may performed with the developing roller 23 and the photoconductive drum 11 abutting on each other during the driving.

3. Relationship Between Toner Coating to Developing Roller and Voltage

Next, the influence of voltage due to the coating state of the toner 22 on the developing roller 23, will be described. In a case where the common power source is provided for the charging high-voltage terminal 74*a* and the developing blade high-voltage terminal 74*b* as in the high-voltage configuration according to the fourth embodiment and the amount of the toner 22 formed as a layer on the developing roller 23 is smaller than that in an ordinary image-forming period, even when the charging voltage is applied, developing blade voltage is less likely to be acquired. This is because of an increase of current that flows directly from the developing roller 23 to the developing blade 25 because the developing blade 25 and the developing roller 23 easily come in contact with each other due to a small amount of toner 22 interposed between the developing blade 25 and the developing roller 23. That is current to originally flow does not flow, resulting in occurrence of a voltage drop.

Figure 17:
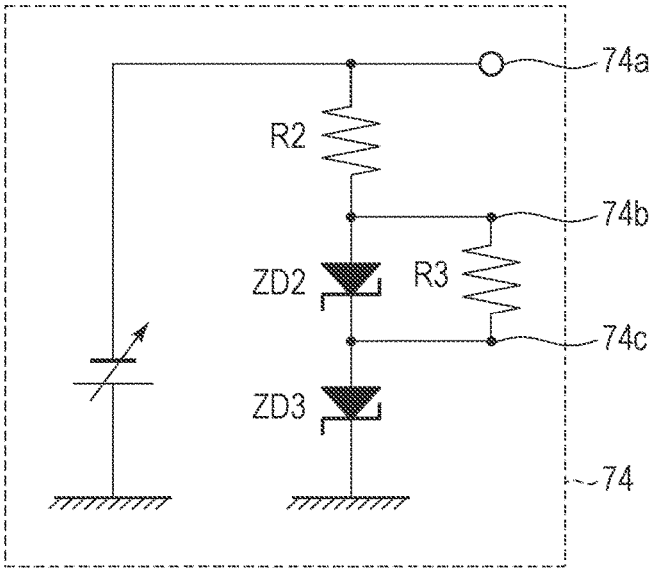
FIG. 17 illustrates the configuration of a high-voltage power source according to the fourth embodiment.

FIG. 17 is a schematic view of a common high-voltage power source 74 according to the fourth embodiment, in which current flows directly from the developing roller 23 to the developing blade 25. When the common high-voltage power source 74 outputs voltage, current flows from the developing roller 23 to the developing blade 25 with reception of resistance. FIG. 17 illustrates a resistor R3 as a path through which charge flows directly from the developing roller 23 to the developing blade 25. The resistance value of the resistor R3 varies depending on, for example, the respective materials or shapes of the developing roller 23 and the developing blade 25, the contact area between the developing roller 23 and the developing blade 25, or the material or amount of the toner 22 interposed between the developing roller 23 and the developing blade 25. The resistance value of the resistor R3 increases as the amount of the toner 22 interposed between the developing roller 23 and the developing blade 25 increases. When the amount of the toner 22 interposed between the developing roller 23 and the developing blade 25 is the same in degree as that in the ordinary image-forming period, the resistance value of the resistor R3 is sufficiently large. Thus, the value of current flowing through the resistor R3 is negligibly smaller than the value of current flowing through a Zener diode ZD2.

Figure 18:
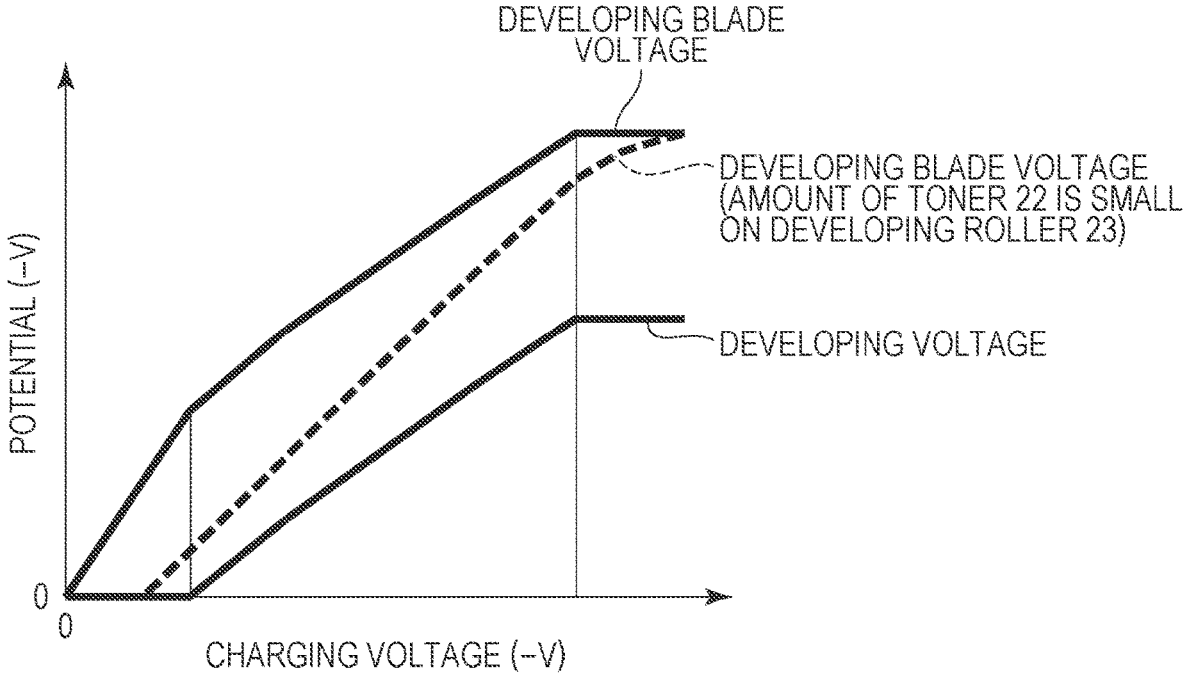
FIG. 18 illustrates the relationship between charging voltage and developing blade voltage, according to the fourth embodiment.

FIG. 18 illustrates the developing blade voltage with a broken line when the charging voltage varies onto the negative polarity side, in a case where the resistance value of the resistor R3 decreases. A flow of current through the resistor R3 causes the Zener diode ZD2 not to easily acquire a sufficient current for clamping a predetermined potential, so that the developing blade voltage decreases. Meanwhile, even in a case where current flows through the resistor R3, current that flows through a Zener diode ZD2 is constant, so that the developing voltage does not vary. As a result, in a case where current flows through the resistor R3, the potential difference Δ between the developing blade voltage and the developing voltage is smaller than that in a case where no resistor R3 is present. Thus, the potential difference Δ between the developing roller 23 and the developing blade 25 cannot be appropriately retained. As a result, the triboelectric charging amount of the toner 22 tends to be lower than that in the ordinary image-forming period in which the developing roller 23 has been sufficiently coated with the toner 22, so that dripping is likely to occur.

Note that the phenomenon that, in a case where the amount of the toner 22 formed as a layer on the developing roller 23 is smaller than that in the ordinary image-forming period, the developing blade voltage is not acquired easily even when the charging voltage is applied, is not limited to the above configuration. For example, a voltage divider circuit including resistors instead of the Zener diodes, causes a similar issue.

As described above, according to the fourth embodiment, as a feature, provided is the voltage control in the initial setting operation period of the brand-new developing device 20 in which the amount of the toner 22 formed as a layer on the developing roller 23 is smaller than that in the ordinary image-forming period.

As described above, the brand-new developing device 20 is shipped with the toner storage chamber 27*a* sealed with the sealing member 26 in order to prevent the toner 22 from leaking out of the developer container 21 during transport of the brand-new developing device 20. In the brand-new developing device 20 with the toner storage chamber 27*a* sealed, it is likely to take time for supply of a sufficient amount of toner 22 from the toner storage chamber 27*a* to the periphery of the developing roller 23. Thus, when use of the brand-new developing device 20 starts, the initial setting operation of supplying the toner 22 sufficiently to the periphery of the developing roller 23 requires performing. Reduction of the amount of the toner 22 interposed between the developing blade 25 and the developing roller 23 during the initial setting operation, causes charge to flow directly easily from the developing roller 23 to the developing blade 25.

Next, the coating state of the toner 22 on the developing roller 23 and the amount of voltage drop will be described. When the developing roller 23 is coated with no toner 22, the developing blade 25 and the developing roller 23 abut on each other directly, so that current flows most easily. Meanwhile, in a case where the image-forming preparation has been made by the initial setting operation, because the toner 22 that is an insulator is interposed between the developing roller 23 and the developing blade 25, current flowing from the developing roller 23 to the developing blade 25 is negligibly small.

Figure 19:
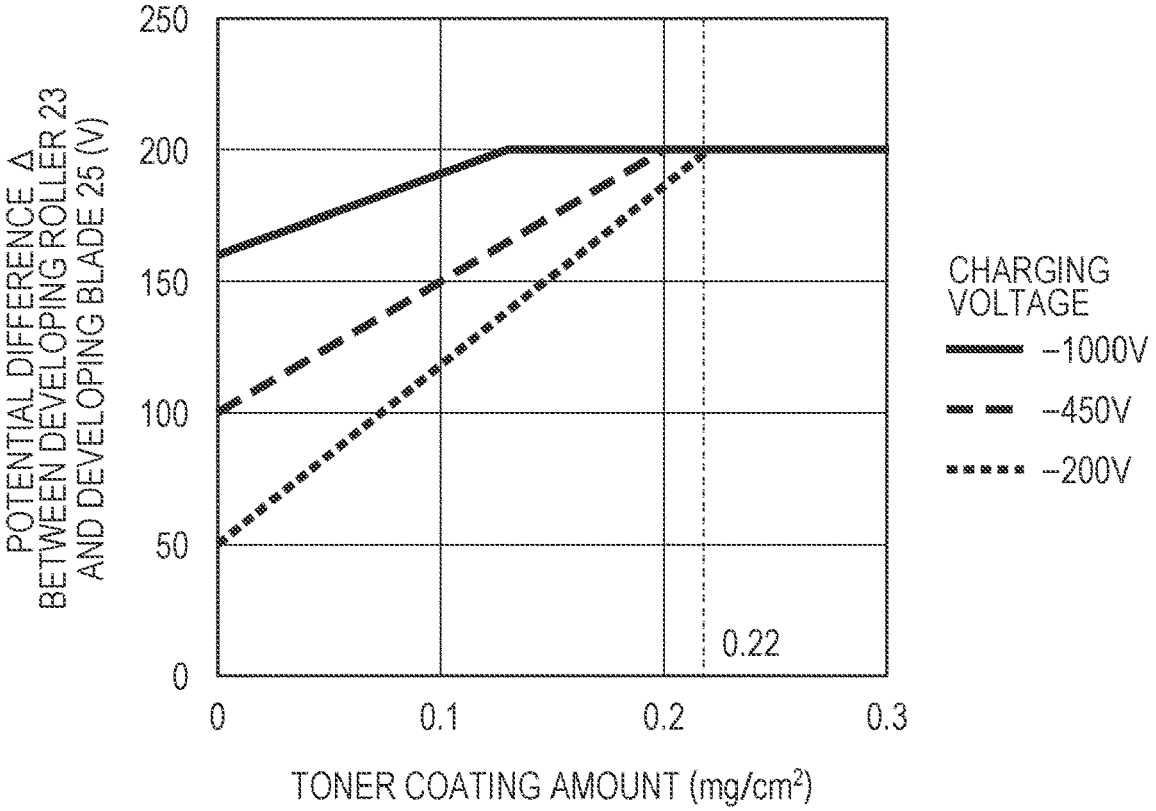
FIG. 19 illustrates the toner coating amount on a developing roller and the potential difference between developing voltage and the developing blade voltage, according to the fourth embodiment.

FIG. 19 illustrates the relationship between the coating amount of the toner 22 on the surface of the developing roller 23 and the potential difference Δ between the developing blade voltage and the developing voltage. In this case, the charging voltage to be applied is switched between three bases of a voltage of −1000 V (V1) to be applied in the image-forming period, a voltage of −540 V as discharge start voltage, and a voltage of −120 V (V3) lower than the discharge start voltage. The coating amount of the toner 22 is expressed by the mass of the toner 22 per unit area of the developing roller 23.

From the result of FIG. 19, in a case where the coating amount of the toner 22 is 0.22 mg/cm$^2$ or more, it can be found that the potential difference Δ between the developing blade voltage and the developing voltage can be secured at any charging voltage. Therefore, preferably, the coating amount of the toner 22 on the developing roller 23 is 0.22 mg/cm$^2$ at lowest. However, for the brand-new process cartridge 10, because of the start with the developing roller 23 coated with the lubricant 28, the potential difference Δ between the developing blade voltage and the developing voltage cannot be secured at a low charging voltage of −120 V. Therefore, the charge of the toner 22 on the developing roller 23 is not retained, so that toner dripping is likely to occur. Meanwhile, even in a case where the developing roller 23 is coated with no toner 22, the potential difference Δ between the developing blade voltage and the developing voltage is secured at −1000 V or −540 V. Then, gradual increase of the coating amount of the toner 22 on the developing roller 23 along with rotation of the developing roller 23, causes increase of the potential difference Δ between the developing blade voltage and the developing voltage. Thus, the charge of the toner 22 is stabilized.

Figure 20:
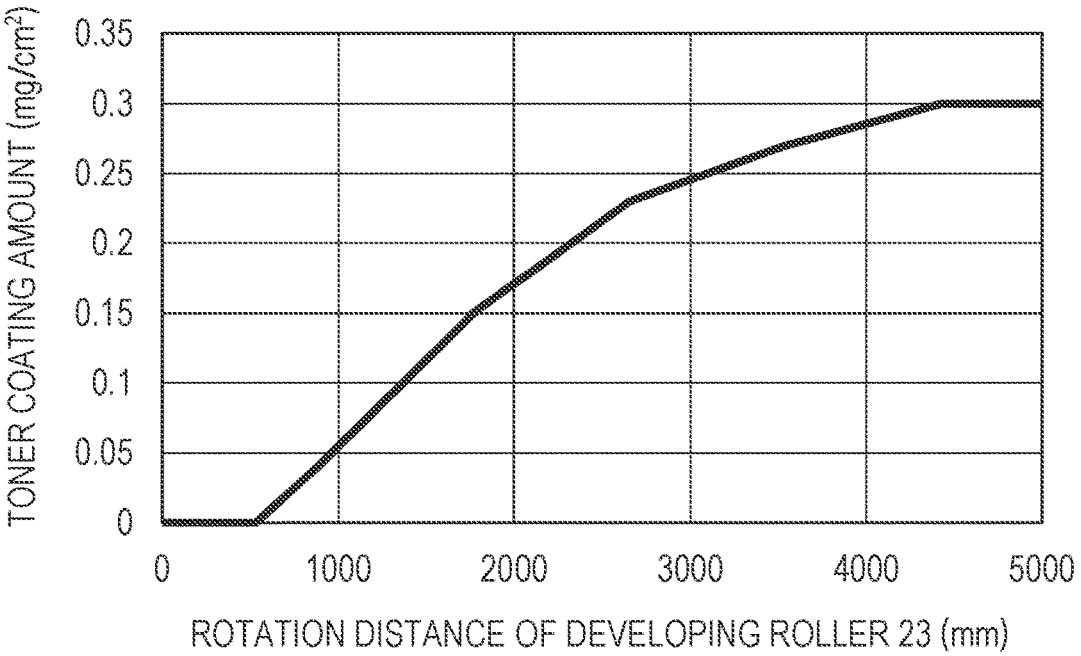
FIG. 20 illustrates the relationship between the rotation distance of the developing roller and the toner coating amount on the developing roller, according to the fourth embodiment.

FIG. 20 illustrates the relationship between the rotation distance of the developing roller 23 from the initial setting state and the coating amount of the toner 22. The developing roller 23 rotates with the potential difference Δ between the developing blade voltage and the developing voltage, at 200 V. In a case where the rotation distance of the developing roller 23 is 4400 mm or more, the coating amount of the toner 22 is equivalent to the coating amount in the image-forming period. Therefore, the developing roller 23 needs to rotate at least by a distance of 4400 mm or more. According to the fourth embodiment, the rotation speed of the developing roller 23 is 175 mm/sec and the outer diameter of the developing roller 23 is 10 mm. Thus, rotation for 25 sec causes the developing roller 23 to be coated sufficiently with the toner 22.

Referring to FIGS. 19 and 20, for the control of the charging voltage of the common power source in the initial setting operation, the fourth charging voltage V4 is −540 V.

Application of a voltage of −540 V causes the photoconductive drum 11 to be inhibited from being influenced by discharging, and causes the potential difference Δ between the developing blade voltage and the developing voltage, to be retained at 50 V at lowest in the initial state. Therefore, acquisition of a potential difference of 50 V in the initial state in which the coating amount of the toner 22 is zero, enables the toner 22 on the developing roller 23, to retain a charge amount with which the toner 22 is prevented from dripping.

4. Voltage Control of Common Power Source in Initial Setting Operation

In a case where the process cartridge 10 including the brand-new developing device 20 is installed in the image forming apparatus 300, the image forming apparatus 300 determines that the process cartridge 10 is brand-new, with the brand-new cartridge detection, and performs the initial setting operation. The voltage control of the common high-voltage power source 74 in the initial setting operation period, will be described with FIGS. 21 and 22.

Figure 21:
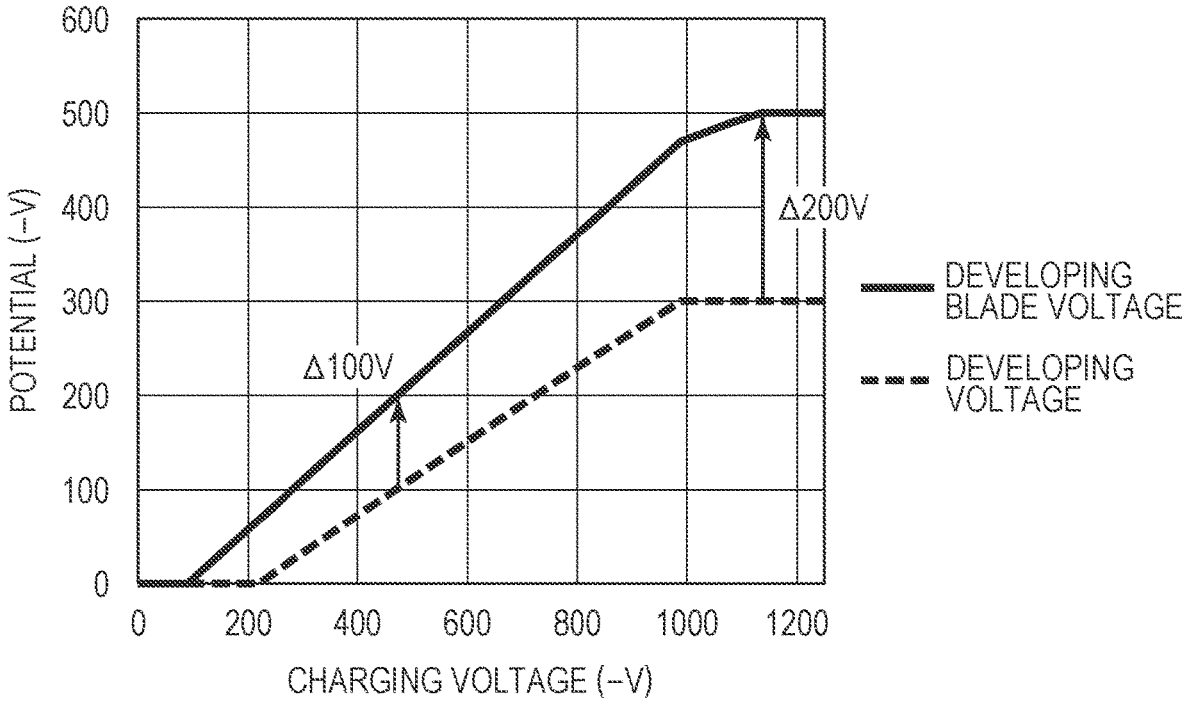
FIG. 21 illustrates the relationship between the charging voltage and the developing blade voltage, according to the fourth embodiment.

FIG. 21 illustrates the respective variations of the developing blade voltage and the developing voltage when the charging voltage varies in the process cartridge 10 including the brand-new developing device 20.

In the brand-new developing device 20 according to the fourth embodiment, the amount of the toner 22 formed as a layer on the developing roller 23 is smaller than that in the ordinary image-forming period. Thus, as described above, in comparison to a case where a layer is formed of the toner 22 in amount necessary for ordinary image forming, the developing blade voltage acquired at the same charging voltage is smaller in absolute value.

According to the fourth embodiment, with the developing roller 23 coated with no toner 22, sufficient current for the Zener diode ZD2 to clamp the desired voltage, does not flow with the charging voltage in the range lower than −1140 V. Therefore, the potential difference Δ of the developing blade voltage to the developing voltage is smaller than 200 V. Then, the developing blade voltage is 0 V at a charging voltage of −100 V.

Figure 22:
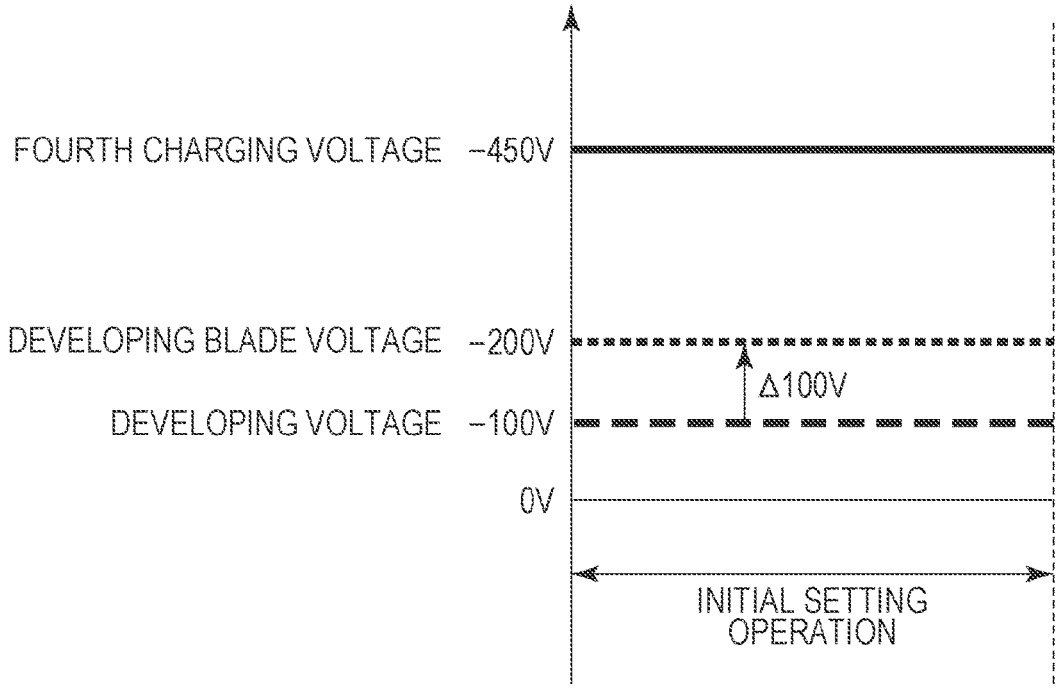
FIG. 22 illustrates the relationship between voltages in a brand-new cartridge detection operation period, according to the fourth embodiment.

FIG. 22 illustrates each output voltage of the common high-voltage power source in the initial setting operation period of the image forming apparatus 300. Because no image forming is performed in the initial setting operation period, similarly in the cleaning operation period according to the third embodiment, the surface potential of the photoconductive drum 11 requires no retaining at a constant value. Because the developing roller 23 is spaced apart from the photoconductive drum 11, the developing voltage requires no applying. Thus, the developing voltage can be made at 0 V. However, the potential difference Δ between the developing voltage and the developing blade voltage in the initial setting operation period is smaller than those in the conditions according to the first to third embodiments. Thus, preferably, the fourth charging voltage V4 higher than the third charging voltage V3 used in the cleaning operation period, is applied in the initial setting operation period in order to acquire the potential difference Δ of the developing blade voltage to the developing voltage, sufficient for retention of the negative chargeability of the toner 22.

According to the fourth embodiment, at a fourth charging voltage V4 of −450 V in the initial setting operation period, the developing blade voltage is −200 V as indicated in the characteristics of the common high-voltage power source 74 of FIG. 21. Thus, the potential difference Δ of the developing blade voltage to the developing voltage is initially 100 V. Use of the fourth charging voltage V4 in the initial setting operation period, causes no discharging to be performed to the photoconductive drum 11, and enables retention of negative-charge-providing performance to the toner 22 due to the developing blade 25, sufficient for inhibition of dripping.

Note that, according to the fourth embodiment, the fourth charging voltage V4 is −450 but the fourth charging voltage V4 is not limited to this. The fourth charging voltage V4 requires at least to be smaller its absolute value than −1000 V as the first charging voltage V1, and is required at least to enable retention of the potential difference Δ between the developing blade voltage and the developing voltage, at above 50 V. That is, in the configuration according to the fourth embodiment, any voltage larger in absolute value than −200 V and smaller in absolute value than a first charging voltage V1 of −1000 V in the image-forming period can be selected as the fourth charging voltage V4. However, because of a fear that the photoconductive drum 11 deteriorates due to discharging, more preferably, the fourth charging voltage V4 is the charging voltage at the discharge start voltage or less. Therefore, preferably, the range of the fourth charging voltage V4 satisfies the following expression:

$$V1(V)<V4(V)<-200(V) \quad \text{Expression (5)}$$

More preferably, the range of the fourth charging voltage V4 satisfies the following expression:

$$-540(V)\leq V4(V)\leq -200(V) \quad \text{Expression (6)}$$

According to the fourth embodiment, the fourth charging voltage V4 is −450 V so that the potential difference Δ between the developing blade 25 and the developing roller 23 can be retained at 100 V or more from beginning to end. As a more preferable condition, the fourth charging voltage V4 may be −540 V so that the potential difference Δ between the developing blade 25 and the developing roller 23 can be secured most.

The fourth charging voltage V4 may vary in stages within the initial setting operation period. For example, the value of the fourth charging voltage V4 may be decreased in accordance with the progress of the initial setting operation. Specifically, as illustrated in FIG. 20, in response to the variation of toner coating on the developing roller 23, the minimum charging voltage enabling securing of the potential difference Δ between the developing blade voltage and the developing voltage, may be controlled so as to be applied.

5. Effect Verification

Table 4 indicates inhibition effect on deterioration of the photoconductive drum 11 due to discharging and dripping at each set charging voltage value in the initial setting operation period.

TABLE 4

| | Charging voltage | Influence of discharging | Dripping |
|---|---|---|---|
| Comparative example 1 | 0 V | ○ | X |
| Comparative example 2 | −1000 V (V1) | X | ○ |
| Third embodiment | −120 V (V3) | ○ | X |
| Fourth embodiment | −450 V (V4) | ○ | ○ |

As Comparative Example 1, in a case where the charging voltage to be applied in the toner purging execution period is 0 V, and as Comparative Example 2, in a case where the charging voltage to be applied in the toner purging execution period is −1000 V the same as that in the image-forming period, effect verification is performed similarly.

According to Comparative Example 1, because no discharging is performed to the photoconductive drum 11 at a charging voltage of 0 V, the photoconductive drum 11 can be inhibited from deteriorating due to discharging. However, because the developing blade voltage is 0 V, toner dripping occurs. According to the third embodiment, similarly, no discharging is performed to the photoconductive drum 11 at a third charging voltage V3 of −120 V. Thus, the photoconductive drum 11 can be inhibited from deteriorating due to discharging. However, the potential difference Δ of the developing blade voltage to the developing voltage cannot be secured in necessary amount, so that toner dripping cannot be inhibited.

As in Comparative Example 2, when the charging voltage is a first charging voltage V1 of −1000 V in the image-forming period, the potential difference Δ of the developing blade voltage to the developing voltage is sufficiently acquired. Thus, toner dripping can be inhibited. However, because discharging is performed to the photoconductive drum 11, similarly in the image-forming period, the photoconductive drum 11 deteriorates due to the discharging.

Thus, as in the fourth embodiment, when the charging voltage is a fourth charging voltage V4 of −450 V, no discharging is performed to the photoconductive drum 11, so that the photoconductive drum 11 can be inhibited from deteriorating due to discharging. In addition, the potential difference Δ of the developing blade voltage to the developing voltage is acquired, so that toner dripping can be inhibited.

As described above, in the image forming apparatus 300, appropriate selection of the fourth charging voltage V4 in the initial setting operation enables the photoconductive drum 11 to be inhibited from deteriorating due to discharging and toner dripping to be inhibited.

An image forming apparatus 300 according to a fifth embodiment is the same as the image forming apparatus 300 according to the fourth embodiment. Here, particular points according to the fifth embodiment will be only described. The same members are denoted with the same reference signs, and the descriptions of similar parts will be omitted.

According to the fifth embodiment, as a feature, provided is voltage control in a case where a developing device 20 has reached its service life, in which the amount of toner 22 formed as a layer on a developing roller 23 is smaller than that in an ordinary image-forming period. The amount of the toner 22 inside the developing device 20 having reached its service life is small, so that the toner 22 is less likely to be sufficiently supplied to the developing roller 23. In this case, the amount of the toner 22 formed as a layer on the developing roller 23 is smaller than that in the ordinary image-forming period, so that charge flows directly easily from a developing blade 25 to the developing roller 23.

1. Toner Amount Detection

First, a method of detecting the amount of the toner 22 inside a developer container 21, will be described. According to the fifth embodiment, a technique of estimating the consumed amount of the toner 22, on the basis of image information (pixel count value) in the image-forming period, is used for remaining-amount detection. Note that the toner amount detection is not limited to this. For example, a known technique, such as an optical remaining-amount detection technique or a capacitive technique, may be used.

As illustrated in FIG. 15, a memory 15 provided at a process cartridge 10 enables reading information and writing information in communication with a CPU 155 included in the image forming apparatus 300 through a communication unit 80 that is a detection unit. That is, according to the fifth embodiment, the CPU 155 includes a control unit 202, an arithmetic unit, a storage unit (ROM), and a clock, and further has a function of reading information from and writing information into the memory 15 through the communication unit 80. The CPU 155 further functions as a count unit that performs pixel counting to be described below (counting of image signals).

The memory 15 stores at least the number of image-formed (printed) sheets and the cumulative number of counts of individual image signals forming image dots in image forming (hereinafter, referred to as dots) (cumulative number of pixel counts). Then, the amount of the toner 22 having been consumed (namely, developed and used) can be estimated from the number of image-formed sheets or the cumulative number of pixel counts that has been stored.

Here, the pixel counting means counting individual image signals forming dots. The image forming apparatus 300 according to the fifth embodiment is, for example, a laser beam printer having a resolution of 600 dpi (dots per inch). The image formable region of a letter-size sheet (216 mm×279 mm) is 204 mm×269 mm equivalent to 4878 dots×6420 dots in dots. Image data to be print-output is sent as an electric signal from a host computer (not illustrated) to the CPU 155. The image data may be sent from, for example, an image reading unit provided at the body of the image forming apparatus 300. The CPU 155 converts the image data into a video signal every one scan line, and creates a laser drive signal in accordance with the video signal. Then, an exposure unit 3 is controlled between emission and non-emission, resulting in irradiation of a photoconductive drum 11. When the video signal is sent as a signal for laser emission to a laser unit, a horizontal synchronizing signal (BD signal) is placed at the head of the scan line. Because the video signal is transmitted after a certain time period from the BD signal, the start position of the video signal can be verified by detection of the BD signal.

For counting of dots in each region, counting starts from zero every certain time period. A result of the counting is sent to a dot-number storage memory (not illustrated), resulting in storage every region to which the counting has been performed. In this manner, the number of dots can be counted in the direction of laser scanning in each region. Counting of the number of BD signals enables acquisition of the number of scan lines. In this manner, the number of dots is counted every region, resulting in storage in the dot-number storage memory.

The CPU 155 stores a value of $30\times10^{-9}$ (g) as the used amount of the toner 22 per one pixel count and a value of 50 g as the initial filled amount of the toner 22 with which a brand-new developer container 21 is filled. The amount of the toner 22 in the developer container 21 in use is calculated (acquired) from the difference between the initial filled amount of the toner 22 and the product of the used amount of the toner 22 per one pixel count and the cumulative number of pixel counts counted by pixel counting.

Note that, according to the fifth embodiment, the value stored in advance in the CPU 155 is used for acquisition of the used amount of the toner 22 per one pixel count. As necessary, successive correction may be performed with, for example, the usage history, usage environment, or output image pattern of the process cartridge 10 or the image forming apparatus 300, or the value of each type of detection function provided to the process cartridge 10 or the image forming apparatus 300.

2. Voltage Control of Common Power Source after Developing Device Reaches its Service Life After the developing device 20 reaches its service life, as described above, the amount of the toner 22 inside the developing device 20 having reached its service life is small, and thus the toner 22 is less likely to be sufficiently supplied to the developing roller 23. In this case, similarly in the initial setting operation period according to the fourth embodiment, even when charging voltage is applied, developing blade voltage is not acquired easily. Thus, voltage control different from that in the ordinary image-forming period is required after the developing device 20 reaches its service life.

Voltage control of a common high-voltage power source 74 after the developing device 20 reaches its service life, will be described with FIGS. 23 and 24. Note that, according to the fifth embodiment, it is determined that the developing device 20 has reached its service life, at the point in time when the amount of the toner 22 inside the developer container 21 is calculated at 10 g as a reference value by the remaining-amount detection for the toner 22. However, the reference for the developing device 20 having reached its service life, is not limited to this.

Figure 23:
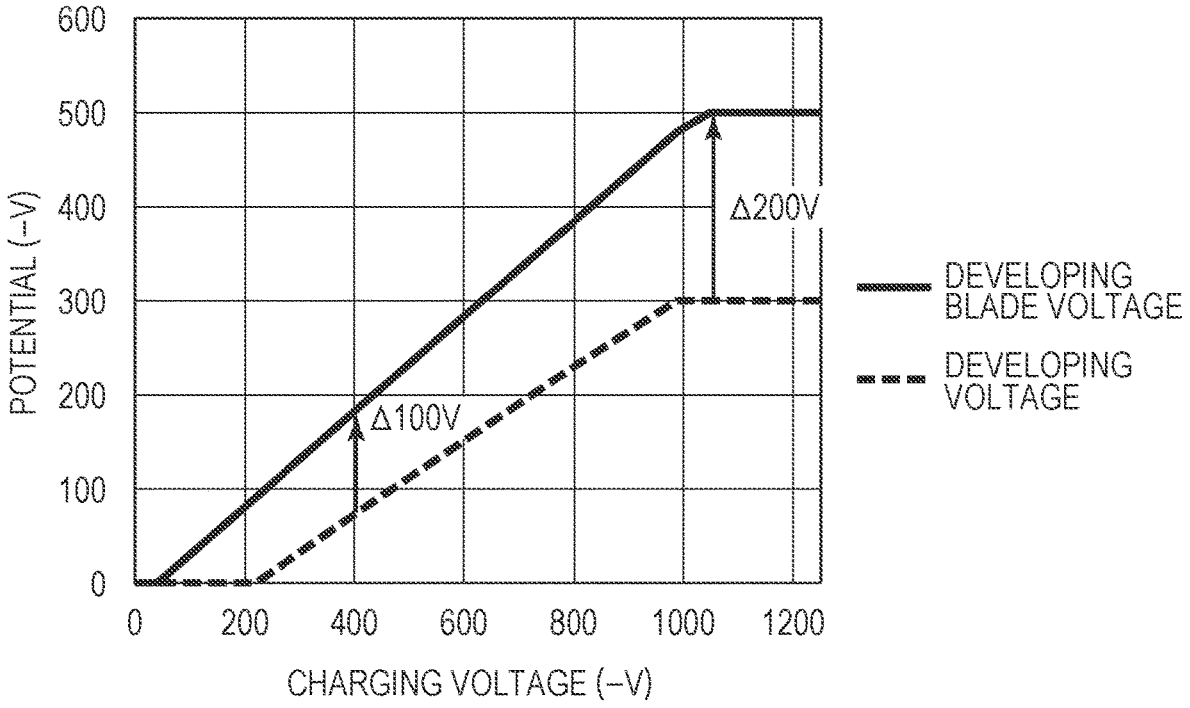
FIG. 23 illustrates the relationship between charging voltage and developing blade voltage, according to an example fifth embodiment.

FIG. 23 illustrates the developing blade voltage and developing voltage when the charging voltage varies in the process cartridge 10 including the developing device 20 having reached its service life. According to the fifth embodiment, in the developing device 20 having reached its service life, the amount of the toner 22 formed as a layer on the developing roller 23 is smaller than that in the ordinary image-forming period.

The coating amount of the toner 22 in the ordinary image-forming period is 0.30 mg/cm$^2$, and the coating amount of the toner 22 after arrival of the service life is 0.10 mg/cm$^2$. A predetermined value of the coating amount of the toner 22 is set at 0.30 mg/cm$^2$. In a case where the coating amount of the toner 22 is 0.10 mg/cm$^2$ lower than the predetermined value, from the result of FIG. 19, the developing blade voltage after arrival of the service life decreases by 20 V in the image-forming period. Thus, as described above, in comparison to a case where a layer is formed of the toner 22 in amount necessary for ordinary image forming, the developing blade voltage acquired at the same charging voltage is smaller.

According to the fifth embodiment, sufficient current for a Zener diode ZD2 to clamp a desired voltage, does not flow with the charging voltage in the range lower in absolute value than −1050 V, so that the potential difference Δ of the developing blade voltage to the developing voltage is smaller than 200 V. Then, the developing blade voltage is 0 V at a charging voltage of −50 V. In comparison between this result and that in the initial setting operation period according to the fourth embodiment, it can be found that there is a difference of 90 V at the voltage for causing the potential difference Δ to reach 200 V and there is a difference of 50 V at the voltage for causing the developing blade voltage to reach 0 V. This means less passage of current after arrival of the service life because the coating amount of the toner 22 after arrival of the service life according to the fifth embodiment is larger than that in the initial setting operation period.

Figure 24:
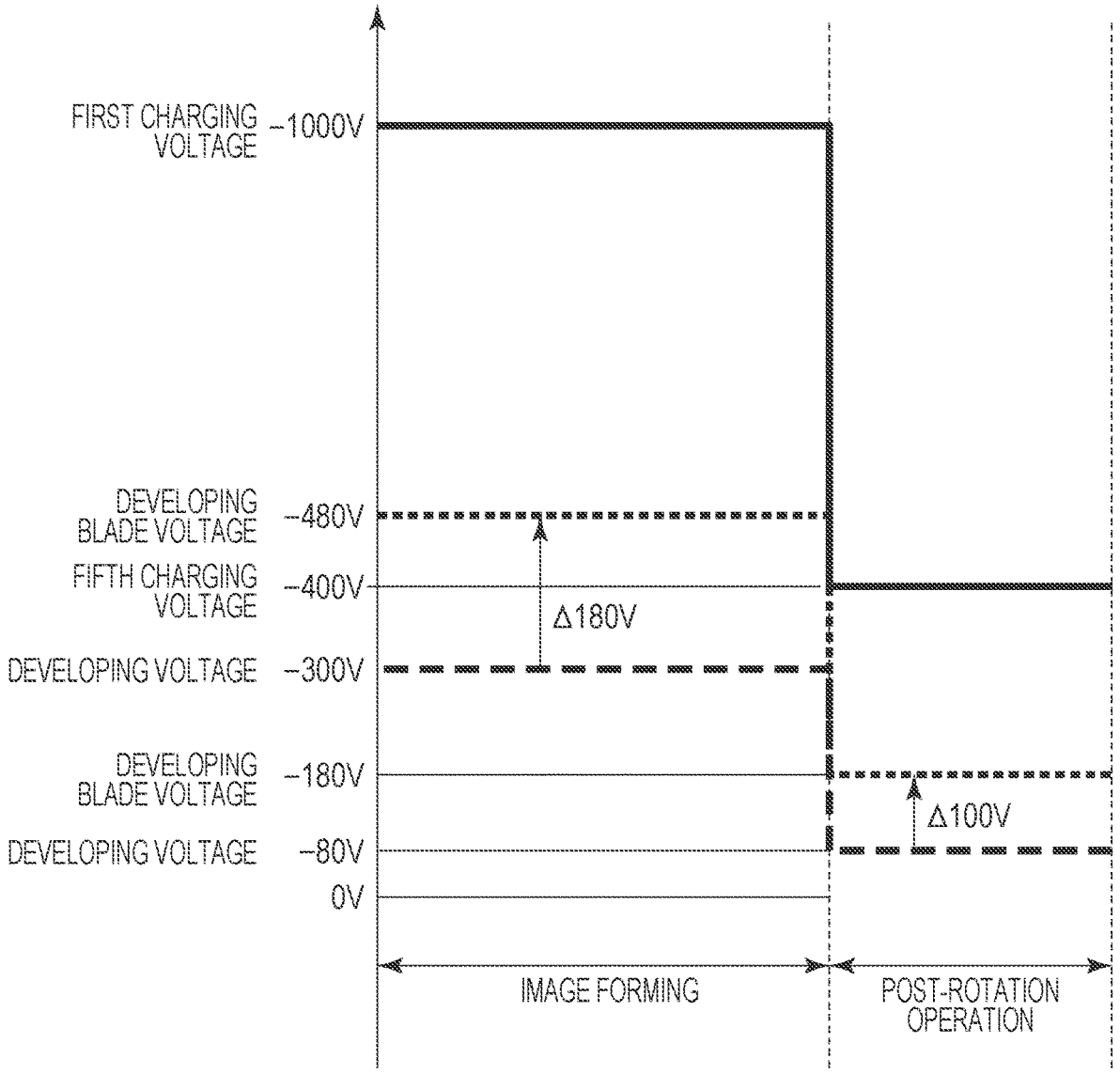
FIG. 24 illustrates the relationship in voltage between an image-forming period and a non-image-forming period, after a process cartridge reaches its service life, according to the fifth embodiment.

FIG. 24 illustrates each output voltage of the common high-voltage power source in the image-forming period and a post-rotation operation period after the developing device 20 reaches its service life in the image forming apparatus 300. Even after the developing device 20 reaches its service life, preferably, as described above, the charging voltage in a non-image-forming period is smaller than that in the ordinary image-forming period, from the viewpoint of prevention of the photoconductive drum 11 from deteriorating due to discharging. However, the potential difference between the developing voltage and the developing blade voltage is smaller after the developing device 20 reaches its service life than before the developing device 20 reaches its service life. Thus, in the non-image-forming period after the developing device 20 reaches its service life, preferably, fifth charging voltage V5 is applied in order to sufficiently acquire the potential difference Δ of the developing blade voltage to the developing voltage. Preferably, the fifth charging voltage V5 is larger than the third charging voltage V3 and is smaller than the fourth charging voltage V4. This is because the coating state of the toner 22 on the developing roller 23 varies even in the same non-image-forming period.

The coating amount of the toner 22 with which the developing roller 23 is coated is constant between in the cleaning operation period of a charging roller 12 in which the third charging voltage V3 is applied and in the image-forming period. Therefore, current passing from the developing roller 23 to the developing blade 25 is negligibly small. Thus, the charging voltage for imparting charge to the toner 22 on the developing roller 23, can be lowered.

Meanwhile, no toner 22 with which the developing roller 23 is coated is present in the initial setting operation period in which the fourth charging voltage V4 is applied. Therefore, a large amount of current passes from developing roller 23 to the developing blade 25, resulting in occurrence of a voltage drop. Thus, the charging voltage for imparting charge to the toner 22 on the developing roller 23, requires setting higher.

The developing roller 23 is coated less with the toner 22 after arrival of the service life according to the fifth embodiment after which the fifth charging voltage V5 is applied, than in the cleaning operation period, but is coated with the toner 22 more than in the initial setting operation period. Therefore, although the voltage cannot be decreased to the third charging voltage V3, the voltage can be decreased below the fourth charging voltage V4. Therefore, preferably, the following expression is satisfied:

$$|V3|<|V5|\leq|V4| \qquad \text{Expression (7)}$$

According to the fifth embodiment, during image forming, the image forming apparatus 300 applies a voltage of −1000 V as first charging voltage V1, so that the developing blade voltage is −480 V and the potential difference Δ of the developing blade voltage to the developing voltage is 180 V. Application of the fifth charging voltage V5 at −400 V in the non-image-forming period after the developing device 20 reaches its service life, causes the developing blade voltage to be −180 V and the developing voltage to be −80 V, as illustrated in the characteristics of the common high-voltage power source 74 of FIG. 23. This arrangement causes the potential difference Δ of the developing blade voltage to the developing voltage, to be 100 V, so that the potential difference Δ between the developing roller 23 and the developing blade 25 can be retained. For the toner 22 used in the fifth embodiment, because the potential difference Δ of the developing blade voltage to the developing voltage is 100 V even after arrival of the service life, negative-charge-providing performance to the toner 22, sufficient for inhibition of toner dripping, can be retained. For use of toner to which negative-charge-providing performance deteriorates, for example, due to a variation in the amount of an external additive on the toner, preferably, after arrival of the service life, the fifth charging voltage V5 is appropriately increased such that the potential difference Δ of the developing blade voltage to the developing voltage is sufficiently acquired for inhibition of toner dripping.

Note that, according to the fifth embodiment, the fifth charging voltage V5 is −400 V, but the fifth charging voltage V5 is not limited to this. Thus, the fifth charging voltage V5 requires at least to be smaller in absolute value than −1000 V as the first charging voltage V1, and is required at least to enable retention of the potential difference Δ between the developing blade voltage and the developing voltage, at above 50 V. That is, referring to FIG. 24, any voltage larger than −100 V and smaller than −1000 V can be selected as the fifth charging voltage V5 in the configuration according to the fifth embodiment. However, because of a fear that the photoconductive drum 11 deteriorates due to discharging, more preferably, the fifth charging voltage V5 is the charging voltage at discharge start voltage or less. Therefore, preferably, the range of the fifth charging voltage V5 satisfies the following expression:

$$V1(V)<V5(V)<-100(V) \quad \text{Expression (8)}$$

More preferably, the range of the fifth charging voltage V5 satisfies the following expression:

$$-540(V)\leq V5(V)<-100(V) \quad \text{Expression (9)}$$

According to the fifth embodiment, the fifth charging voltage V5 is −400 V so that the potential difference Δ between the developing blade 25 and the developing roller 23 can be secured at 100 V.

The fifth charging voltage V5 may vary in stages after the developing device 20 reaches its service life. For example, the fifth charging voltage V5 may be increased in accordance with continuous use of the developing device 20 after the developing device 20 reaches its service life. Specifically, in response to variation in the remaining amount of the toner 22, the minimum charging voltage enabling securing of the potential difference Δ between the developing blade voltage and the developing voltage, is controlled so as to be applied. After use of the fifth charging voltage V5 starts in the post-rotation operation period after the developing device 20 reaches its service life, preferably, the use of the fifth charging voltage V5 continues in the post-rotation operation period.

3. Effect Verification

Table 5 indicates inhibition effect on deterioration of the photoconductive drum 11 due to discharging and toner dripping at each set charging voltage value in the non-image-forming operation period after arrival of the service life.

TABLE 5

| | Charging voltage | Influence of discharging | Dripping |
|---|---|---|---|
| Comparative example 1 | 0 V | ○ | X |
| Comparative example 2 | −1000 V (V1) | X | ○ |
| Third embodiment | −120 V (V3) | ○ | X |
| Fifth embodiment | −400 V (V5) | ○ | ○ |

As Comparative Example 1, in a case where the charging voltage to be applied in the toner purging execution period is 0 V, and as Comparative Example 2, in a case where the charging voltage to be applied in the toner purging execution period is −1000 V the same as that in the image-forming period, effect verification is performed similarly. According to Comparative Example 1, because no discharging is performed to the photoconductive drum 11 at a charging voltage of 0 V, the photoconductive drum 11 can be inhibited from deteriorating due to discharging. However, because the developing blade voltage is 0 V, toner dripping occurs. According to the third embodiment, similarly, no discharging is performed to the photoconductive drum 11 at a third charging voltage V3 of −120 V. Thus, the photoconductive drum 11 can be inhibited from deteriorating due to discharging. However, the potential difference Δ of the developing blade voltage to the developing voltage cannot be secured in necessary amount, so that toner dripping occurs slightly.

As in Comparative Example 2, when the charging voltage is a first charging voltage V1 of −1000 V in the image-forming period, the potential difference Δ of the developing blade voltage to the developing voltage is sufficiently acquired. Thus, toner dripping can be inhibited. However, because discharging is performed to the photoconductive drum 11, similarly in the image-forming period, the photoconductive drum 11 deteriorates due to the discharging.

Thus, as in the fifth embodiment, when the charging voltage is a fifth charging voltage V5 of −400 V, no discharging is performed to the photoconductive drum 11, so that the photoconductive drum 11 can be inhibited from deteriorating due to discharging. In addition, the potential difference Δ of the developing blade voltage to the developing voltage is acquired, so that toner dripping can be inhibited.

As described above, in the image forming apparatus 300, appropriate selection of the fifth charging voltage V5 after the process cartridge 10 reaches its service life enables the photoconductive drum 11 to be inhibited from deteriorating due to discharging and toner dripping to be inhibited.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-241799, filed Dec. 25, 2018, which is hereby incorporated by reference herein in its entirety.

What is claimed is:

1. An image forming apparatus configured to form an image onto a recording medium, the image forming apparatus comprising:

a photosensitive member that is rotatable;

a charging member configured to charge a surface of the photosensitive member;

a developing roller configured to carry a developer and supply the developer charged in normal polarity to the surface of the photosensitive member;

a regulating member configured to regulate the developer on a surface of the developing roller;

a common voltage applying unit configured to apply charging voltage and regulating voltage to the charging member and the regulating member, wherein when the charging voltage changes, the regulating voltage also changes, respectively;

a detection unit configured to detect whether a developing device including the developing roller and the regulating member is unused; and a control unit configured to control the voltage applying unit, wherein an image-forming operation is performed in which the developer charged in the normal polarity is supplied to the surface of the photosensitive member to form a developer image for the formation of the image onto the recording medium, and a non-image-forming operation including a detection operation in which the detection unit detects whether the developing device is unused is performed in which the photosensitive member and the developing roller rotate, the non-image-forming operation being different from the image-forming operation, wherein, in a state when the developing roller is being rotated, the control unit controls the voltage applying unit so as to form a potential difference between the regulating member and the developing roller, which applies an electrostatic force to the developer charged to the normal polarity in a direction from the regulating member toward the developing roller, by applying the charging voltage to the charging member, according to the regulating member being charged with the regulating voltage, in such a manner that an absolute value of the charging voltage during the non-image-forming operation period is smaller than that during the image-forming operation period, and the charging voltage in the detection operation is smaller in absolute value than the charging voltage in the period of the non-image-forming operation without the detection operation.

2. The image forming apparatus according to claim 1, further comprising:

a voltage retaining element connected to the regulating member and the developing roller, wherein the common voltage applying unit applies the charging voltage to the charging member, to cause the voltage retaining element to retain the potential difference formed between the regulating member and the developing roller, at a predetermined potential.

3. The image forming apparatus according to claim 2, wherein the voltage retaining element is a Zener diode.

4. The image forming apparatus according to claim 1, wherein the common voltage applying unit serves as a voltage applying unit configured to apply developing voltage to the developing roller.

5. The image forming apparatus according to claim 1, wherein the control unit controls the charging voltage to be applied to the charging member in the period of the non-image-forming operation such that no discharging occurs from the charging member between the photosensitive member and the charging member.

6. The image forming apparatus according to claim 1, wherein the potential difference between the regulating member and the developing roller is 50 V or more.

7. The image forming apparatus according to claim 1, wherein the non-image-forming operation includes a pre-rotation operation to be performed before the image-forming operation.

8. The image forming apparatus according to claim 1, wherein the non-image-forming operation includes a post-rotation operation to be performed after the image-forming operation.

9. The image forming apparatus according to claim 1, wherein the non-image-forming operation includes a cleaning operation in which the developer adhering to the charging member is moved to the photosensitive member, to clean the charging member.

10. The image forming apparatus according to claim 9, wherein the cleaning operation includes moving developer charged in reverse polarity to the photosensitive member, and wherein the control unit performs control such that the charging voltage to be applied to the charging member in the cleaning operation is smaller in absolute value than the charging voltage to be applied to the charging member in the period of the non-image-forming operation without the cleaning operation.

11. The image forming apparatus according to claim 1, further comprising:

a developer container housing the developer; and a remaining-amount detection unit configured to detect a remaining amount of the developer housed in the developer container, wherein the control unit performs control such that the charging voltage to be applied to the charging member in the period of the non-image-forming operation is changed, based on the remaining amount of the developer detected by the remaining-amount detection unit.

12. The image forming apparatus according to claim 11, wherein the control unit performs control, in a case where the remaining amount of the developer detected by the remaining-amount detection unit is less than a reference value, such that the charging voltage to be applied to the charging member in the period of the non-image-forming operation, increases in absolute value.

13. The image forming apparatus according to claim 1, wherein the control unit performs control such that the charging voltage to be applied to the charging member in the period of the non-image-forming operation is changed, based on an amount of the developer formed on the surface of the developing roller.

14. The image forming apparatus according to claim 13, wherein the control unit performs control, in a case where the amount of the developer formed on the surface of the developing roller is less than a predetermined value, such that the charging voltage to be applied to the charging member in the period of the non-image-forming operation, increases in absolute value.

15. The image forming apparatus according to claim 13, wherein the amount of the developer is mass of the developer per unit area of the developing roller.

* * * * *